US009291044B2

(12) United States Patent
Murphy et al.

(10) Patent No.: US 9,291,044 B2
(45) Date of Patent: Mar. 22, 2016

(54) METHOD AND APPARATUS FOR ISOLATING AND TREATING DISCRETE ZONES WITHIN A WELLBORE

(75) Inventors: Robert Murphy, Montgomery, TX (US); Gary D. Ingram, Richmond, TX (US); Simon J. Harrall, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 760 days.

(21) Appl. No.: 12/411,338

(22) Filed: Mar. 25, 2009

(65) Prior Publication Data

US 2010/0243254 A1 Sep. 30, 2010

(51) Int. Cl.

| | |
|---|---|
| ***E21B 43/26*** | (2006.01) |
| ***E21B 23/01*** | (2006.01) |
| ***E21B 33/124*** | (2006.01) |
| ***E21B 43/12*** | (2006.01) |

(52) U.S. Cl.

CPC ..... *E21B 43/26* (2013.01); *E21B 23/01* (2013.01); *E21B 33/124* (2013.01); *E21B 43/121* (2013.01)

(58) Field of Classification Search

CPC ..... E21B 33/12; E21B 33/124; E21B 33/129; E21B 23/00; E21B 23/06; E21B 33/122; E21B 33/1294

USPC ..... 166/305.1, 306, 308.1, 307, 373, 381, 166/382, 386, 129, 133, 183, 186

See application file for complete search history.

(56) References Cited

U.S. PATENT DOCUMENTS

| | | | | |
|---|---|---|---|---|
| 3,024,846 | A * | 3/1962 | Gage | 166/317 |
| 3,096,823 | A | 7/1963 | Crowe | |
| 3,526,278 | A | 9/1970 | Scott | |
| 4,485,876 | A | 12/1984 | Speller | |
| 4,605,062 | A * | 8/1986 | Klumpyan et al. | 166/127 |
| 4,856,583 | A * | 8/1989 | Greenlee et al. | 166/127 |
| 5,782,306 | A | 7/1998 | Serafin | |
| 6,253,856 | B1 | 7/2001 | Ingram et al. | |
| 6,257,339 | B1 * | 7/2001 | Haugen et al. | 166/387 |
| 6,655,461 | B2 | 12/2003 | Eslinger et al. | |
| 6,695,057 | B2 | 2/2004 | Ingram et al. | |
| 6,782,954 | B2 | 8/2004 | Serafin et al. | |
| 6,823,945 | B2 | 11/2004 | Eslinger et al. | |
| 6,832,654 | B2 | 12/2004 | Ravensbergen et al. | |
| 6,883,610 | B2 | 4/2005 | Depiak | |

(Continued)

OTHER PUBLICATIONS

RoboPacker—New Solution for Coiled Tubing Fracturing and Other Applications Requiring Zonal Isolation, Depiak Indutrial Technology, Product Report, Jun. 2005.

(Continued)

*Primary Examiner* — Elizabeth Gitlin

(74) *Attorney, Agent, or Firm* — Patterson & Sheridan, L.L.P.

(57) ABSTRACT

A method and apparatus for conducting a fracturing operation using a wellbore fracturing assembly. The assembly may be mechanically set and released from a wellbore using a coiled tubing string to conduct a fracturing operation adjacent an area of interest in a formation. The assembly may include an unloader for equalizing pressure between the assembly and the wellbore, a pair of spaced apart packers for straddling the area of interest, an injection port disposed between the packers for injecting fracturing fluid into the area of interest, and an anchor for securing the assembly in the wellbore. After conducting the fracturing operation, the assembly may be relocated to another area of interest to conduct another fracturing operation.

30 Claims, 20 Drawing Sheets

(56) References Cited

U.S. PATENT DOCUMENTS

| | | | | |
|---|---|---|---|---|
| 7,011,157 | B2 | 3/2006 | Costley et al. | |
| 7,032,675 | B2 * | 4/2006 | Steele et al. | 166/373 |
| 7,051,812 | B2 | 5/2006 | McKee et al. | |
| 7,472,746 | B2 | 1/2009 | Maier | |
| 7,478,676 | B2 | 1/2009 | East, Jr. et al. | |
| 7,484,565 | B2 | 2/2009 | van Batenburg et al. | |
| 2004/0129421 | A1 | 7/2004 | Hoffman et al. | |
| 2004/0251022 | A1 | 12/2004 | Smith | |
| 2007/0068676 | A1 | 3/2007 | Shkurti | |
| 2007/0193741 | A1 * | 8/2007 | Smith | 166/250.17 |
| 2008/0190605 | A1 | 8/2008 | Clapp et al. | |
| 2010/0243254 | A1 | 9/2010 | Murphy et al. | |

OTHER PUBLICATIONS

Australian Examination Report for Patent Application No. 2010201173 dated May 3, 2011.

Canadian Office Action for Application No. 2,697,394 dated Dec. 19, 2011.

Extended European Search Report; EP Application No. 10157828.4-2315; Oct. 24, 2012.

* cited by examiner

METHOD AND APPARATUS FOR ISOLATING AND TREATING DISCRETE ZONES WITHIN A WELLBORE

BACKGROUND OF THE INVENTION

1. Field of the Invention

Embodiments of the invention relate to a wellbore fracturing assembly including an anchor, packers, a injection port, and an unloader. In one aspect, the assembly is lowered into a wellbore on a coiled tubing string and the assembly is mechanically set and released by pulling and pushing on the coiled tubing string.

2. Description of the Related Art

In certain wellbore operations, it is desirable to "straddle" an area of interest in a wellbore, such as an oil formation, by packing off the wellbore above and below the area of interest. A sealed interface is set above the area of interest and another sealed interface is set below the area of interest. Typically the area of interest undergoes a treatment, such as fracturing, to assist the recovery of hydrocarbons from the straddled formation.

A variety of straddling tools are available, the most common being a cup-type tool. These tools are effective at shallow depths but may have maximum depth limitations at around 6,000 feet due to the swabbing effect induced on the wellbore liner by the tool coming out of the hole. Another type of tool includes hydraulically actuated packers disposed above and below an area of interest. However, this hydraulically actuated tool relies on a valve to open and shut to allow a fluid back pressure to set the packers, which is susceptible to flow cutting during pumping operations.

Therefore, there is a need for a new and improved wellbore treatment assembly. There is a further need for an effective treatment assembly that can be utilized at deeper locations in well. There is an even further need for a treatment assembly that can be operated using coiled tubing.

SUMMARY OF THE INVENTION

Embodiments of the invention generally relate to methods for conducting wellbore treatment operations and apparatus for a wellbore treatment assembly.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 7A and 7A-1 illustrates a cross sectional view of a packer in an unset position according to one embodiment of the invention.

FIGS. 7B and 7B-1 illustrates a cross sectional view of a packer in a pre-set position according to one embodiment of the invention.

FIGS. 7C and 7C-1 illustrates a cross sectional view of the packer in a set position according to one embodiment of the invention.

FIGS. 7D and 7D-1 illustrates a cross sectional view of the packer in an unloading position according to one embodiment of the invention.

DETAILED DESCRIPTION

The invention generally relates to an apparatus and method for conducting wellbore treatment operations. As set forth herein, the invention will be described as it relates to a wellbore fracturing operation. It is to be noted, however, that aspects of the invention are not limited to use with a wellbore fracturing operation, but are equally applicable to use with other types of wellbore treatment operations, such as acidizing, water shut-off, etc. To better understand the novelty of the apparatus of the invention and the methods of use thereof, reference is hereafter made to the accompanying drawings.

Figure 1:
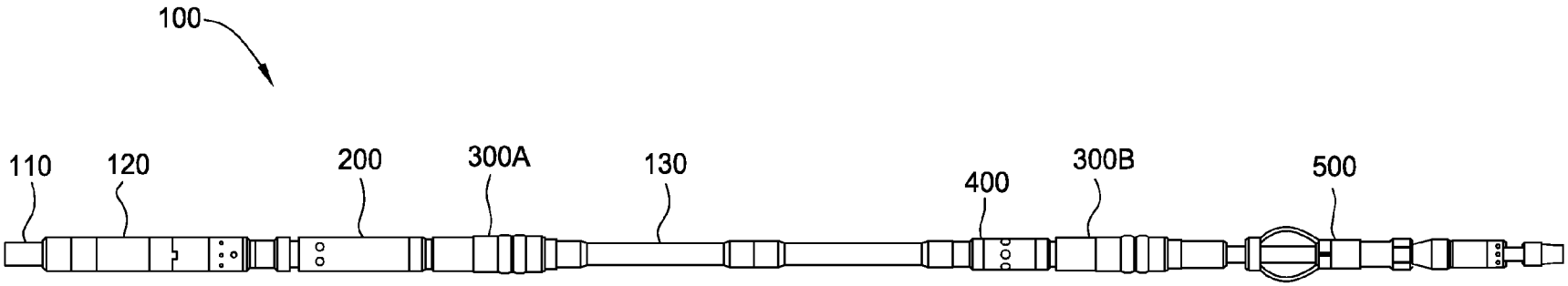
FIG. 1 illustrates a side view of a wellbore treatment assembly according to one embodiment of the invention.

FIG. 1 is a side view of a wellbore fracturing assembly 100 according to one embodiment of the invention. In general, the assembly 100 is lowered into a wellbore on a coiled tubing string 110 at a desired location. Other types of tubular or work strings having tubing or casing may also be used with the assembly 100. To "straddle" or sealingly isolate an area of interest in a formation, the assembly 100 is mechanically set in the wellbore by pulling and pushing on the coiled tubing string 110, thereby placing the assembly 100 in tension and securing the assembly 100 in wellbore and straddling the area of interest. After the assembly 100 is set in the wellbore, a fracturing operation may be conducted through the assembly 100 and directed to the isolated area to fracture the area of interest and recover hydrocarbons from the formation. Upon completion of the fracturing operation, the assembly 100 is mechanically unset from the wellbore by pulling and pushing on the coiled tubing string 100, thereby unstraddling the area of interest and releasing the assembly 100 from the wellbore. The assembly 100 may then be relocated to another area of interest in the formation and re-set to conduct another fracturing operation. As described herein with respect to unsetting the assembly 100, the application of one or more mechanical forces to achieve the unsetting sequence may be accomplished merely by releasing the tension which had been applied to set the assembly 100 in place initially, or may be supplemented by additional force applied by springs within the components and/or by setting weight down on the assembly 100.

As illustrated, the assembly 100 may include an adapter sub 120, an unloader 200, packers 300A and 300B, an injection port 400 disposed between the packers 300A and 300B, and an anchor 500. The assembly 100 may also include one or more spacer pipes 130 disposed between packers 300A and 300B to adjust the straddling length of the assembly 100 depending on the size of the area of interest in the formation to be isolated and/or fractured. In one embodiment, the adapter sub 120 is coupled at its upper end to the tubing string 110 and is coupled at its lower end to the unloader 200. The lower end of the unloader 200 is coupled to the upper end of the packer 300A, which is coupled to the spacer pipe 130. The injection port 400 is coupled to spacer pipe 130 at one end and is coupled to the packer 300B at its opposite end. Finally, the anchor 500 is located at the bottom end of the assembly 100, specifically the anchor 500 is coupled to the lower end of the packer 300B.

The assembly 100 may optionally include the adapter sub 120. The adapter sub 120 may function as a releasable connection point between the tubing string 110 and the rest of the assembly 100 in case of an emergency that requires a quick removal of the tubing string 110 from the wellbore or another event, such as the assembly 100 getting wedged in the wellbore, to allow removal of the tubing string 110 and to allow a retrieval operation. In addition, the adapter sub 120 may operate as a control valve, such as a check valve, to help control the flow of fluid supplied to the assembly 100 to conduct the fracturing operation.

In operation, the assembly 100 is lowered on the tubing string 110 into the wellbore adjacent the area of interest in the formation for conducting a fracturing operation. Once the assembly 100 is positioned in the wellbore, the assembly may be raised and lowered to create an "up and down" motion by pulling and pushing on the tubing string 110 to actuate and set the anchor 500. After the anchor 500 is set and the assembly 100 is secured in the wellbore, tension is further applied to the assembly 100 by pulling on the tubing string 110. The tension in the assembly 100 is utilized to actuate and set the packers 300A and 300B to straddle the area of interest in the formation. The tension in the assembly 100 is also utilized to set the unloader 200 into a closed position to prevent fluid communication between the unloader 200 and the annulus surrounding the assembly 100. The assembly 100 is then held in tension to conduct the fracturing operation.

A fracturing and/or treating fluid, including but not limited to water, chemicals, gels, polymers, or combinations thereof, and further including proppants, acidizers, etc., may be introduced under pressure through the tubing string 110, the adapter sub 120, the unloader 200, the packer 300A, and the spacer pipe 130, and injected out through the injection port 400 into the area of interest of the formation between the packers 300A and 300B. In one embodiment, the assembly 100 may include more than one injection port 400 to facilitate the fracturing operation by reducing the velocity of flow through the injection port 400. In one embodiment, the wellbore and/or wellbore casing or lining may have been perforated adjacent the area of interest to facilitate recovery of hydrocarbons from the formation.

In one embodiment, a device, such as a plug or a check valve, may be located below the assembly 100 to prevent the fracturing and/or treating fluid from flowing through the bottom end of the assembly 100 and to allow pressure to build within the assembly 100 and the area of interest in the formation between the packers 300A and 300B during the fracturing operation. In one embodiment, a device, such as a circulation sub (not shown), may be located above the assembly 100 or the packer 300A. The circulation sub may initially allow a two-way fluid communication flow between the assembly 100 and the wellbore surrounding the assembly 100 as the assembly 100 is located in the wellbore. A ball or dart may subsequently be introduced into the circulation sub to prevent fluid flow from the internal throughbore of the assembly 100 to the wellbore surrounding the assembly 100 but allow fluid flow from the wellbore surrounding the assembly 100 to the throughbore of the assembly 100, to permit a fracturing operation.

In one embodiment, one or more seats (not shown) may be located in series within the assembly 100, below the injection port 400, which are configured to receive a ball or dart to close fluid communication through the throughbore of the assembly 100 to permit a fracturing operation. Upon completion of the fracturing operation, the pressure within the assembly 100 may be increased to an amount such that the ball, dart, and/or the seat are extruded through assembly 100 or displaced within the throughbore of the assembly 100 to open fluid communication through the throughbore of the assembly 100 below the injection port 400 to the wellbore surrounding the assembly 100. This open fluid communication may also help equalize the pressure differential across the lower packer 300B to assist unsetting of the packer 300B. The assembly 100 may then be moved to another location in the wellbore and/or another ball or dart may then be introduced on another seat to conduct another fracturing operation. In an alternative embodiment, the one or more seats may be collets that are operable to receive the ball or dart to close fluid communication within the assembly 100 and that are shearable to subsequently allow the ball or dart to be moved to open fluid communication within the assembly 100.

In one embodiment, a device, such as an overpressure valve (not shown), may be located below the assembly 100 to assist in the fracturing operation. The overpressure valve may be actuated, biased, or preset to close fluid communication between the assembly 100 and the wellbore, below the packer 300B, thereby allowing pressure to build in the work string below the injection port 400 and preventing fluid from continuously flowing through the remainder of the work string. Upon completion of the fracturing operation, the pressure within the assembly 100 may be increased to a pressure that temporarily actuates the overpressure valve into an open position to release the pressure within the assembly 100 and to open fluid communication between the assembly 100 and the wellbore surrounding the assembly 100 below the packer 300B. This pressure release may also help equalize the pressure differential across the packer 300B to help facilitate unsetting of the packer 300B. As the pressure drops within the assembly 100, the overpressure valve may then be actuated or biased into a closed position, thereby closing fluid communication between the assembly 100 and the wellbore below the packer 300B.

After the fracturing operation is complete, the tension in the tubing string 110 and the assembly 100 is released, which may be facilitated by pushing on the tubing string 110. The tension release allows the unloader 200 to actuate into an open position to permit fluid communication between the unloader 200 and the annulus surrounding the assembly 100 to equalize the pressure above and below the packer 300A to help unsetting of the packer 300A. The tension release also allows the packers 300A and 300B and the anchor 500 to unset from engagement with the wellbore. The assembly 100 may then be removed from the wellbore. Alternatively, the assembly 100 may be relocated to another area of interest in the formation to conduct another fracturing operation.

In one embodiment, the assembly 100 may include only one packer 300A or 300B that is utilized to conduct the wellbore treatment operation. The packer 300A or 300B may be used to isolate the area of interest by sealing the wellbore either above or below the area of interest. The packer 300A or 300B may be operated as described herein.

In one embodiment, the assembly 100 may include measurement tools to determine various wellbore characteristics. Such measurement tools may include as temperature gages and sensors, pressure gages and sensors, flow meters, and logging devices (e.g. a logging device used to measure the emission of gamma rays from the formation). The assembly 100 may also include power and memory sources to control and communicate with the measurement tools.

Figure 2A:
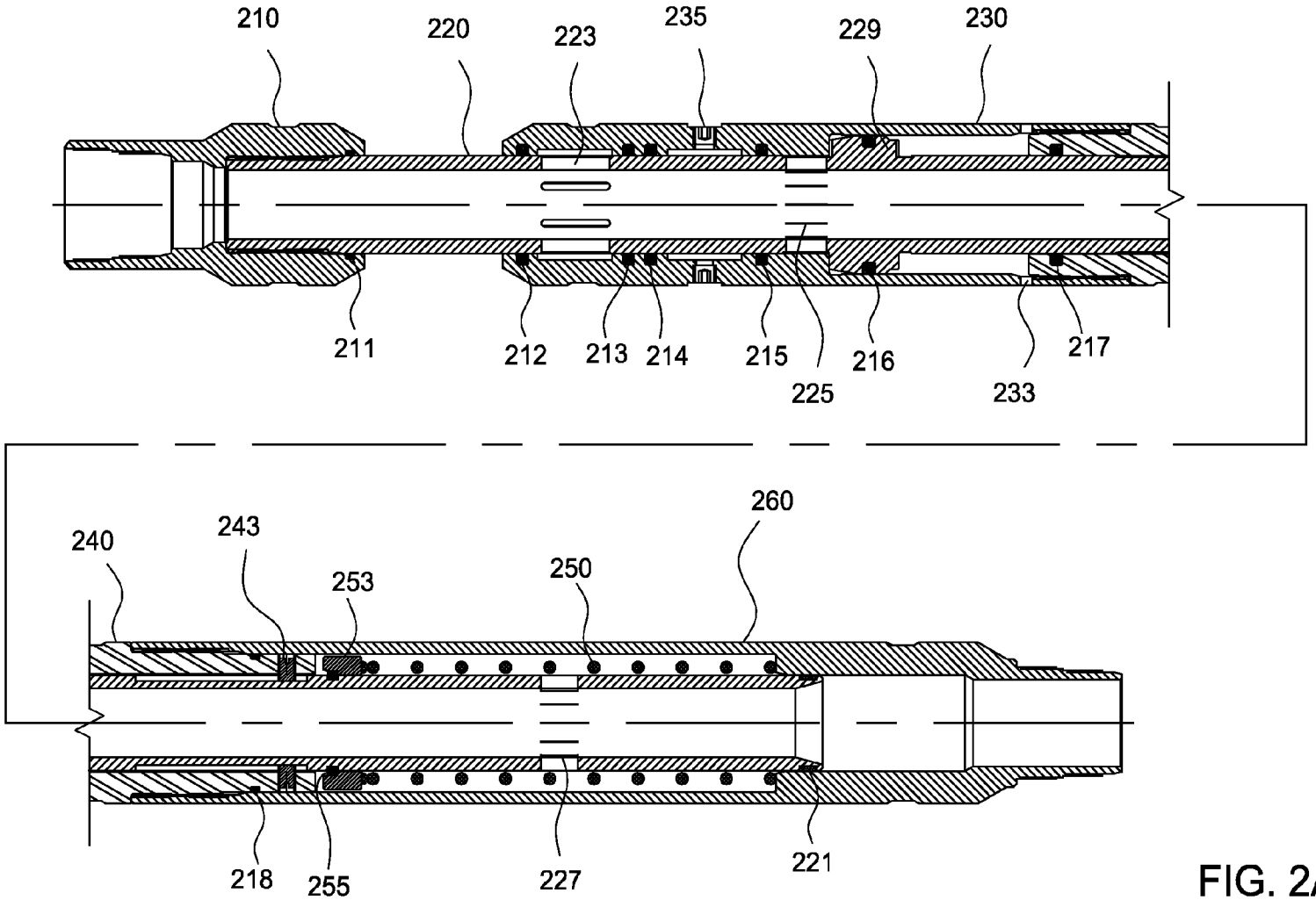
FIG. 2A illustrates a cross sectional view of an unloader in a closed position according to one embodiment of the invention.

FIG. 2A illustrates the unloader 200 according to one embodiment of the invention. The unloader 200 is operable to help equalize the pressure above and below the packer 300A to reduce the pressure differential subjected to the packer 300A during unsetting of the packer, as well as equalize the pressure internal and external to the assembly 100. This pressure equalization helps unset the packer 300A from the wellbore, so that the assembly 100 may be moved in the wellbore without damaging the packer 300A for subsequent sealing. The unloader 200 is operable to open and close fluid communication between the tubing string 110 and the annulus of the wellbore surrounding the assembly 100. When the assembly 100 is being located and secured in the wellbore, and when the assembly 100 is being tensioned by pulling on the tubing string 110, the unloader 200 may be actuated and maintained in a closed position. The unloader 200 may then be actuated into an open position after the assembly 100 is released from being tensioned by the tubing string 110 and/or a downward or push force is applied to the assembly 100 via the tubing string 110.

The unloader 200 includes a top sub 210, an inner mandrel 220, an upper housing 230, a coupler 240, a biasing member 250, and a lower housing 260. The top sub 210 comprises a cylindrical body having a bore disposed through the body. In one embodiment, the upper end of the top sub 210 may be coupled to the adapter sub 120. In one embodiment, the upper end of the top sub 210 is configured to couple the unloader 200 to a tubing string or other downhole tool positioned above the unloader 200. The lower end of the top sub 210 is coupled to the upper end of the inner mandrel 220. The inner diameter of the top sub 210 is connected to the outer diameter of the inner mandrel 220, such as by a thread, and a seal 211, such as an o-ring, may be used to seal the top sub 210/inner mandrel 220 interface. The top sub 210 is connected to the inner mandrel 220 such that the components are in fluid communication.

The inner mandrel 220 comprises a cylindrical body having a bore disposed through the body. The inner mandrel 220 further includes a first opening 223, a second opening 225, a third opening 227, and a piston 225. The openings 223, 225, 227 may vary in number, may be symmetrically located about the body, and may include laser cut slots disposed through the walls of the body to filter sand, particulates, or other debris from exiting or entering the bore of the inner mandrel 220. The first and second openings 223, 225 and the piston 225 are surrounded by the upper housing 230. The third opening 227 is surrounded by the lower housing 260. The coupler 240 also surrounds the body of the inner mandrel 220 and is disposed between the upper and lower housings 230 and 260 such that the upper housing is coupled to the upper end of the coupler 240 and the lower housing is coupled to the lower end of the coupler 240, thereby enclosing the lower end of the inner mandrel 220. The inner diameters of the housings 230 and 260 may be threadedly coupled to the outer diameter of the coupler 240. The inner mandrel 220 is axially movable relative to the housings 230 and 260 and the coupler 240.

The upper housing 230 includes a cylindrical body having a bore disposed through the body, through which the inner mandrel 220 is provided. The upper housing 230 includes an opening 235 disposed through the body of the housing that establishes fluid communication between the bore of the inner mandrel 220 and the annulus surrounding the unloader 200 via the first opening 223 of the inner mandrel 220. The opening 235 may comprise a nozzle to controllably inject fluid into the annulus surrounding the unloader 200. When the unloader 200 is in the closed position, the first opening 223 of the inner mandrel 220 is sealingly isolated from the opening 235 of the upper housing 230, and when the unloader 200 is in the open position, the first opening 223 of the inner mandrel 220 is in fluid communication with the opening 235 of the upper housing 230. The unloader is actuated into the closed and open positions by relative axial movement between the inner mandrel 220 and the upper housing 230. A plurality of seals 212, 213, 214, and 215, such as o-rings, may be used to seal the inner mandrel 220/upper housing 230 interfaces, above and below the opening 235 of the upper housing 230.

The lower end of the upper housing 230 includes an enlarged inner diameter such that the piston 229 of the inner mandrel 220 is sealingly engaged with the inner diameter of the housing 230 and engages a shoulder formed on the inner diameter of the housing 230. A seal 216, such as an o-ring, may be used to seal the piston 229/upper housing 230 interface. The piston 229 includes an enlarged shoulder disposed on the outer diameter of the inner mandrel 220. In the closed position, piston 229 of the inner mandrel 220 abuts the shoulder formed on the inner diameter of the upper housing 230. The second opening 225 of the inner mandrel 220 is located adjacent the piston 229 of the inner mandrel 220 to allow fluid pressure to be communicated from the bore of the inner mandrel 220 to the piston 229. The lower end of the upper housing 230 includes a port 233 that establishes fluid communication between the annulus surrounding the unloader 200 and a chamber formed between the upper housing 230 and the inner mandrel 220 that is disposed adjacent the piston 229 of the inner mandrel 220. The port 233 may be used to introduce pressure back into the unloader 200 to reduce the pressure differential across the piston 229. Finally, the lower end of the upper housing 230 is coupled to the upper end of the coupler 240.

The coupler 240 includes a cylindrical body having a bore disposed through the body, through which the inner mandrel 220 is provided. The coupler 240 includes a shoulder disposed on its outer diameter against which the ends of the housings 230 and 260 engage. Seals 217 and 218, such as o-rings, may be positioned between the upper housing 230/lower housing 260/coupler 240/inner mandrel 220 interfaces. A set screw 243 is disposed through the body of the coupler 240 and engages a recess in the outer diameter of the inner mandrel 220 such that the inner mandrel is axially movable relative to the coupler 240 but is rotationally fixed relative to the coupler 240 and the upper and lower housings 230 and 260. The piston 229 of the inner mandrel 220 may engage the upper end of the coupler 240 when the unloader 200 is in a fully open position. Finally, the upper end of the lower housing 260 is coupled to the lower end of the coupler 240.

The lower housing 260 includes a cylindrical body having a bore disposed through the body, through which the inner mandrel 220 is provided. The lower housing 260 also includes an enlarged inner diameter at its upper end, forming a chamber between the lower housing 260 and the inner mandrel 220 in which the biasing member 250 is disposed. The third opening 227 of the inner mandrel 220 is in fluid communication with the chamber. The lower end of the inner mandrel 220 sealingly engages a reduced inner diameter at the lower end of the lower housing 260 such that the bore of the inner mandrel 220 exits into the bore of the lower housing 260. A wiper ring 221 may be used at the lower end of the inner mandrel 220 between the inner mandrel 220/lower housing 260 interface to prevent and remove debris that flows through the unloader 200. The lower end of the lower housing 260 may be configured to threadedly connect to the packer 300A or other downhole tool of the assembly 100.

The biasing member 250 may include a spring that abuts a shoulder formed on the inner diameter of the lower housing 260 at one end and abuts a retainer 253 at the other end. The retainer 253 includes a cylindrical body that surrounds the inner mandrel 220 and is operable to retain the biasing member 250. A ring 255 that is partially disposed in the body of the inner mandrel 220 is operable to retain the retainer 253 and transmit the biasing force of the biasing member 250 against the retainer 253 to the inner mandrel 220. The ring 255 includes a cylindrical body that surrounds the inner mandrel 220, such as a split ring, that can be enclosed around the inner mandrel 220. In an alternative embodiment, the ring 255 and the retainer 253 may be integral with the inner mandrel 220 in the form of a shoulder, for example, on the inner mandrel 220 against which the biasing member 250 abuts. The biasing member 250 biases the retainer 253 against the lower end of the coupler 240, which biases the inner mandrel 220 in the closed position via the ring 255. In addition, tensioning of the tubing string 110 may also pull on the top sub 210 and thus the inner mandrel 220 to set and maintain the unloader 200 in the closed position.

Figure 2B:
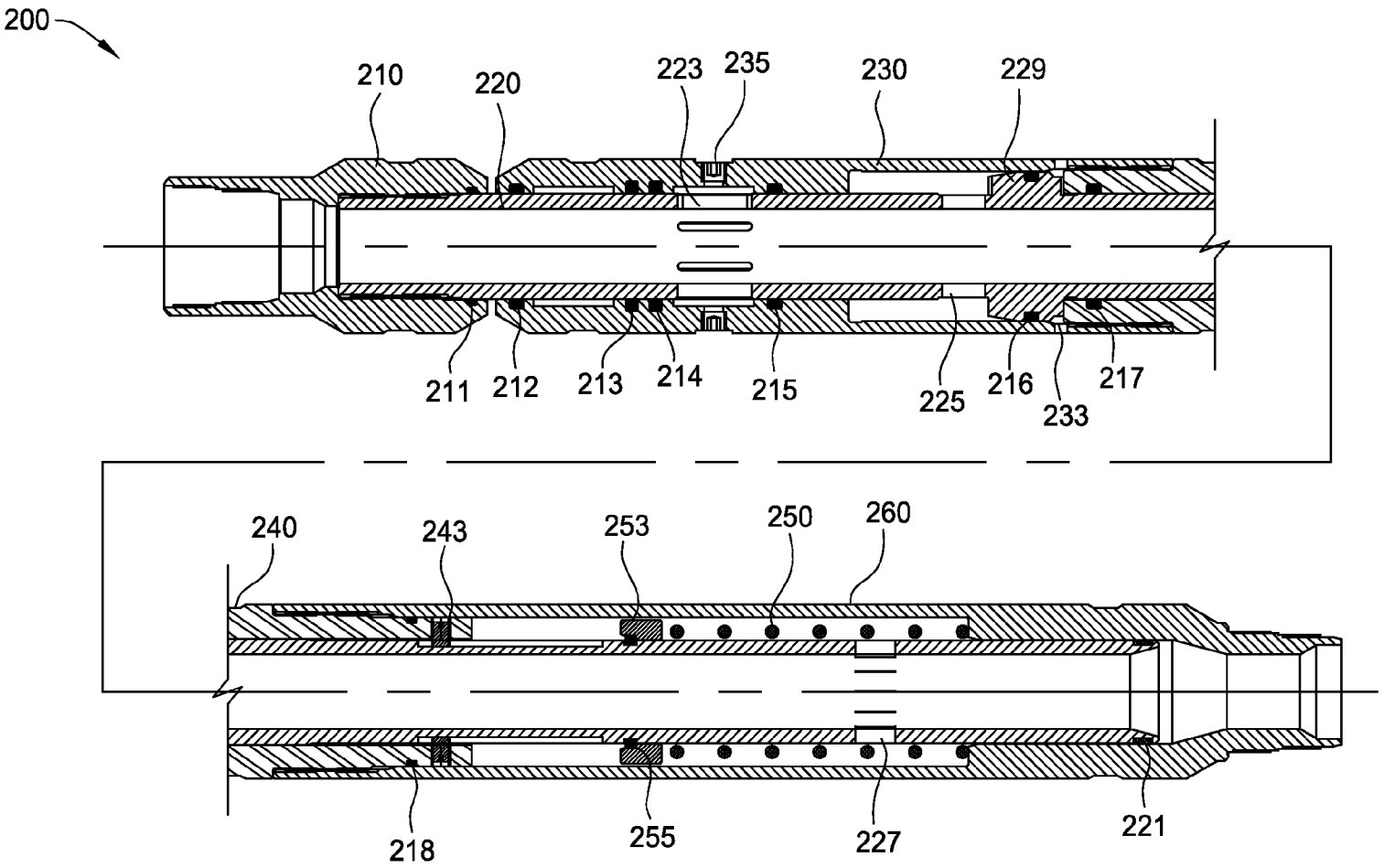
FIG. 2B illustrates a cross sectional view of the unloader in an open position according to one embodiment of the invention.

FIG. 2B illustrates the unloader 200 in the open position according to one embodiment of the invention. A downward or push force may be applied to the top sub 210 via the tubing string 110, thereby axially moving the inner mandrel 220 relative to the upper and lower housings 230 and 260 and the coupler 240 to position the first opening 223 of the inner mandrel 220 in fluid communication with the opening 235 of the upper housing. A fluid may then be injected into the annulus surrounding the unloader 200 to increase the pressure in the annulus, which may help equalize the pressure above and below the packer 300A and reduce the pressure differential across packer 300A to assist unsetting of the packer 300A. At the same time, fluid pressure may be introduced onto the piston 229 of the inner mandrel 220 via the second opening 225 to help control actuation of the unloader 200 into the open position. As stated above, the port 233 may be used to introduce pressure back into the unloader 200 to reduce the pressure differential across the piston 229. Simultaneously, the ring 255, which is engaged with the inner mandrel 220, forces the retainer 253 against the biasing member 250. Fluid pressure is also introduced into the chamber between the lower housing 260 and the inner mandrel 220 via the third opening 227 of the inner mandrel 220, which may further facilitate actuation of the unloader 200 into the open position. The bottom end of the inner mandrel 220 may act as a piston surface to counter balance the piston 229 of the inner mandrel 220 which further enables controlled actuation of the unloader 200.

In one embodiment, a second unloader 200 may be disposed above the lower packer 300B and below the injection port 400 to facilitate unsetting of the packer 300B. A plug, such as a solid blank pipe having no throughbore or a closed end of the injection port 400 or the second unloader 200, is located between the throughbores of the injection port 400 and the second unloader 200 so that flow through the assembly 100 is injected out through the injection port 400. Upon setting of the assembly 100, the second unloader is actuated into the closed position as described above, and a fracturing operation may be conducted in the area of interest (through the injection port 400) without any loss of pressure or fluid through the second unloader 200. After the fracturing operation is complete, the assembly 100 may be unset and the second unloader 200 may be positioned into the open position as described above, thereby opening fluid communication between the throughbore of the second unloader 200 and the wellbore surrounding the second unloader 200. The pressure in the wellbore may be directed from the area of interest in the formation, into the lower end of the assembly 100 via the second unloader 200, and then back out into the wellbore to facilitate unsetting of the packer 300B. In one embodiment, an open port may be located below the packer 300B to allow the pressure from the annulus above the packer 300B to be directed to the annulus below the packer 300B via the second unloader 200 to equalize the pressure across the packer 300B. In one embodiment, an anchor (further described below) having a throughbore in communication with the wellbore may be located below the packer 300B to allow the pressure from the annulus above the packer 300B to be directed to the annulus below the packer 300B via the second unloader 200 to equalize the pressure across the packer 300B.

Figure 3A:
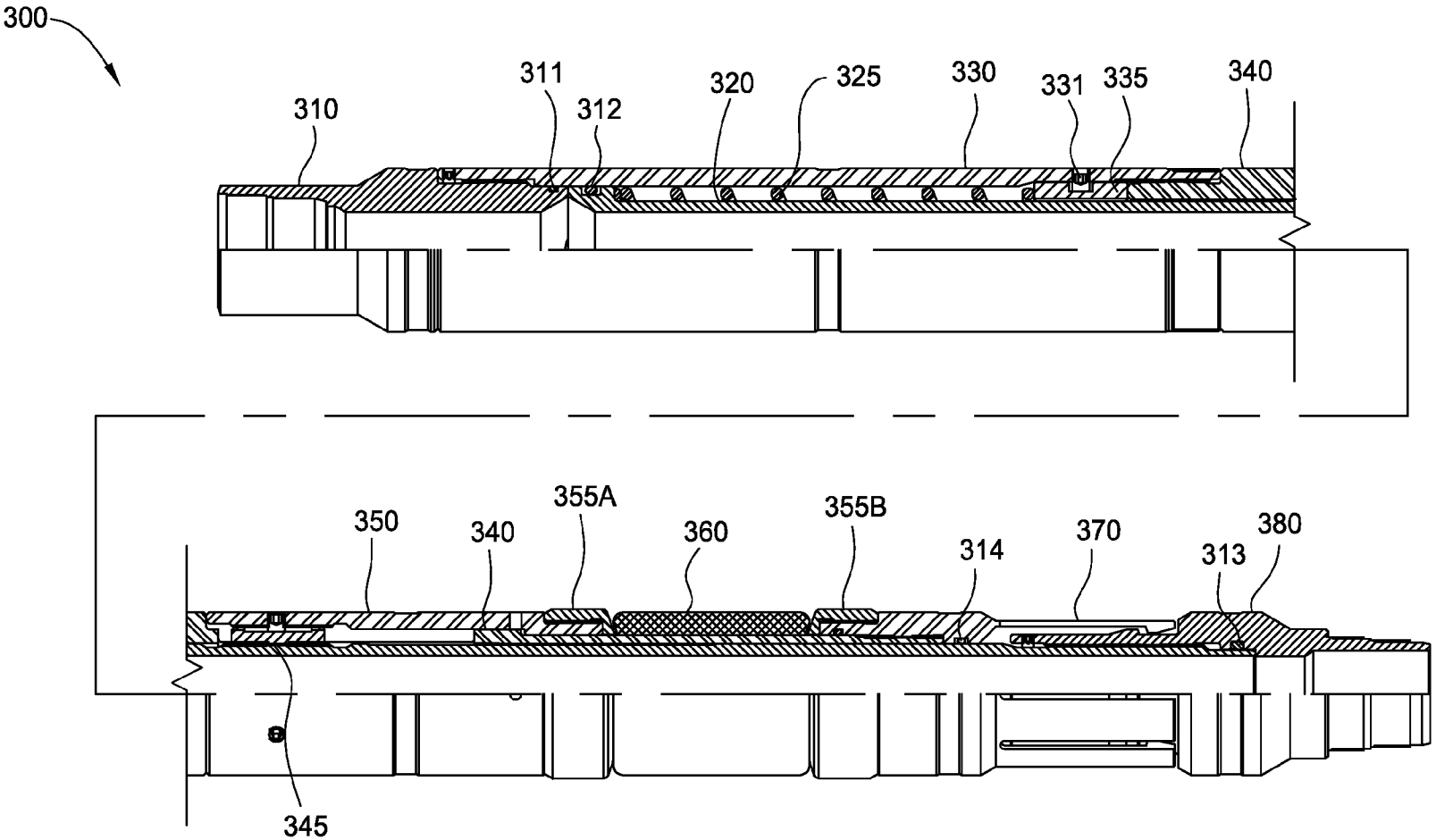
FIG. 3A illustrates a cross sectional view of a packer in an unset position according to one embodiment of the invention.

FIG. 3A illustrates the packer 300 in an unset position according to one embodiment of the invention. The following description of the packer 300 relates to both the packer 300A and 300B as shown in FIG. 1. The packers 300A and 300B are substantially similar in operation and are positioned in tandem within the assembly 100 so that they may be simultaneously actuated, or alternatively, one packer may be set and/or unset prior to the other packer. The packers 300A and 300B may be configured as part of the assembly 100 to be selectively actuated by an upward or pull force that induces tension in the assembly 100, via the tubing string 110 for example. The packers 300A and 300B are operable, for example, to straddle or sealingly isolate an area of interest in a formation for conducting a fracturing operation to recover hydrocarbons from the formation.

The packer 300 includes a top sub 310, an inner mandrel 320, an upper housing 330, a spring mandrel 340, a lower housing 350, a packing element 360, a latch sub 370, and a bottom sub 380. The top sub 310 includes a cylindrical body having a bore disposed through the body. The inner diameter of the upper end of the top sub 310 may be configured to connect to the unloader 200 or other downhole tool of the assembly 100. The lower end of the top sub 310 is coupled to the upper end of the upper housing 330. The top sub 310/upper housing 330 interface may be secured together using, for example, a set screw. The top sub 310/upper housing 330 interface may also include a seal 311, such as an o-ring.

The upper housing 330 includes a cylindrical body having a bore disposed through the body, through which the inner mandrel 320 is provided. The upper housing 330 surrounds the upper end of the inner mandrel 320 such that the bottom end of the top sub 310 abuts the top end of the inner mandrel 320. A seal 312, such as an o-ring, may be provided between the upper housing 330/inner mandrel 320 interface. The upper housing 330 encloses a biasing member 325 that surrounds the inner mandrel 320. The biasing member 325 may include a spring that abuts a shoulder formed on the outer diameter of the upper end of the inner mandrel 320 at one end and abuts the upper end of a retainer 335 at the other end, thereby biasing the inner mandrel 320 against the bottom end of the top sub 310. The biasing member 325 may be used to facilitate unsetting of the packing element 360. The retainer 335 includes a cylindrical body having a bore disposed through the body, through which the inner mandrel 320 is provided. The retainer 335 is surrounded by and coupled to the upper housing 330 by a set screw 331. In an alternative embodiment, the retainer 335 may be integral with the upper housing 330 in the form of a shoulder, for example, on the upper housing 300 against which the biasing member 325 abuts. The lower end of the upper housing 330 is coupled to the spring mandrel 340. The inner diameter of the lower end of the upper housing 330 may be coupled to the outer diameter of the upper end of the spring mandrel 340 such that the upper end of the spring mandrel abuts the retainer 335.

The spring mandrel 340 includes a cylindrical body having a bore disposed through the body, in which the inner mandrel 320 is provided. The lower end of the spring mandrel 340 is coupled to the latch sub 370 to facilitate actuation of the packing element 360. An inner shoulder of the latch sub 370 abuts an edge of the spring mandrel 340. The spring mandrel 340 includes longitudinal slots disposed on its outer diameter for receiving a member 345 that also facilitates actuation of the packing element 360. The member 345 is disposed on and coupled to the inner mandrel 320, and is surrounded by and further coupled to the lower housing 350. The member 345 may include a recess on its outer diameter for receiving a set screw disposed through the body of the lower housing 350 to axially fix the lower housing 350 relative to the inner mandrel 320. The lower housing 350 includes a cylindrical body having a bore disposed through the body, through which the inner mandrel 320 is provided. Also, the lower end of the lower housing 350 surrounds a portion of the spring mandrel 340 such that a shoulder formed on the inner diameter of the lower housing 350 abuts a shoulder formed on the outer diameter of the spring mandrel 340.

As stated above, the lower end of the spring mandrel 340 may be connected to the latch sub 370, which includes a plurality of latching fingers, such as collets, that engage the outer diameter of the bottom sub 380. The packing element 360 may include an elastomer that is disposed around the spring mandrel 340 and between an upper and lower gage 355A and 355B. The gages 355A and 355B are connected to the outer diameters of the lower housing 350 and the latch sub 370, respectively, and include radially inward projecting ends that engage the ends of the packing element 360 to actuate the packing element 360. The latch sub 370/inner mandrel 320 interface may also include a seal 314, such as an o-ring.

The bottom sub 380 includes a cylindrical body having a bore disposed through the body and is coupled to the lower end of the inner mandrel 320. The bottom sub 380/inner mandrel 320 interface may be secured together using, for example, a set screw. The bottom sub 380/inner mandrel 320 interface may also include a seal 313, such as an o-ring. A recessed portion on the outer diameter of the bottom sub 380 is adapted for receiving the latching fingers of the latch sub 370 to prevent premature actuation of the packing element 360. The lower end of the bottom sub 380 may be configured to be coupled to the spacer pipe 130, the anchor 500, or other downhole tool that may be included in the assembly 100.

Figure 3B:
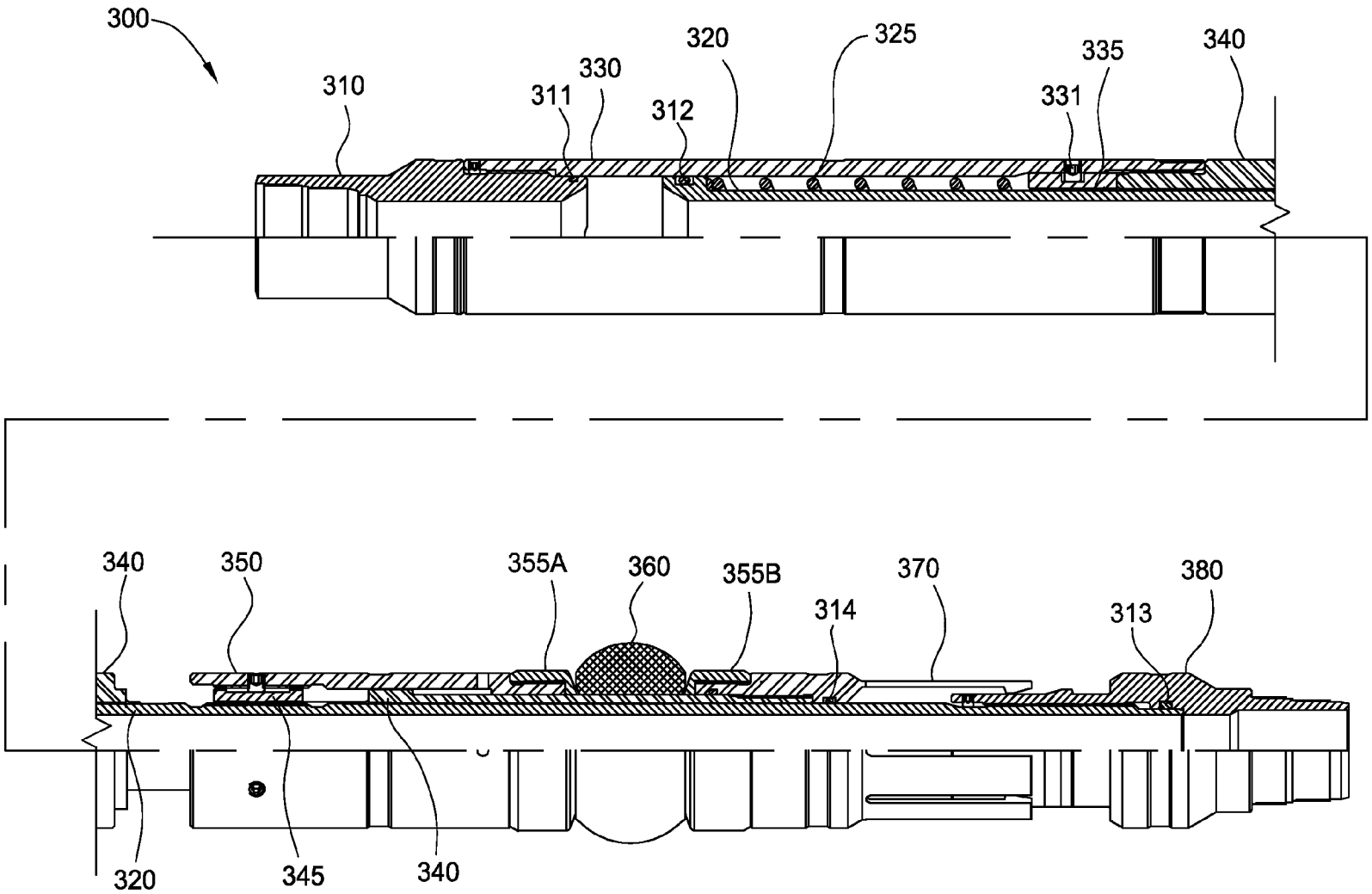
FIG. 3B illustrates a cross sectional view of the packer in a set position according to one embodiment of the invention.

FIG. 3B illustrates the packer 300 in a set position according to one embodiment of the invention. The top sub 310, the upper housing 330, the retainer 335, the spring mandrel 340, and the latch sub 370 are axially movable relative to the inner mandrel 320, the lower housing 350, and the bottom sub 380. As the assembly 100 is tensioned, the top sub 310 is separated from the inner mandrel 320, thereby compressing the biasing member 325 between the shoulder on the inner mandrel 320 and the retainer 335, and the spring mandrel 340 is separated from the lower housing 350, thereby axially moving along the outer diameter of the inner mandrel 320 and pulling on the latch sub 370. Upon the upward or pull force applied to the top sub 310, via the tubing string 110 for example, the latching fingers of the latch sub 370 disengage from the bottom sub 380 to actuate the packing element 360. The latch sub 370 and thus the lower gage 355B are axially moved toward the stationary lower housing 350 and upper gage 355A to actuate the packing element 360 disposed therebetween. The lower housing 350 is axially fixed by the anchor 500 (as will be described below) via the member 345, inner mandrel 320, and bottom sub 380. The packing element 360 is actuated into sealing engagement with the surrounding surface, which may be the wellbore for example. Once the packer 300 is set, fluid pressure that is introduced into the assembly 100 for the fracturing operation may boost the sealing effect of the packing element 360 by telescoping apart the top sub 310 and the inner mandrel 320 as the pressure acts on the bottom end of the top sub 310 and the top end of the inner mandrel 320. The bottom sub 380 may include a piston shoulder on its inner diameter to counter balance the boost enacted upon the packing element 360 to control setting and unsetting of the packing element 360. By releasing the tension in the assembly 100 and/or pushing on the tubing string 110, the top sub 310 and thus the latch sub 370 may be retracted, with further assistance from the biasing member 325, relative to the inner mandrel 320 to unset the packing element 360.

Figure 4:
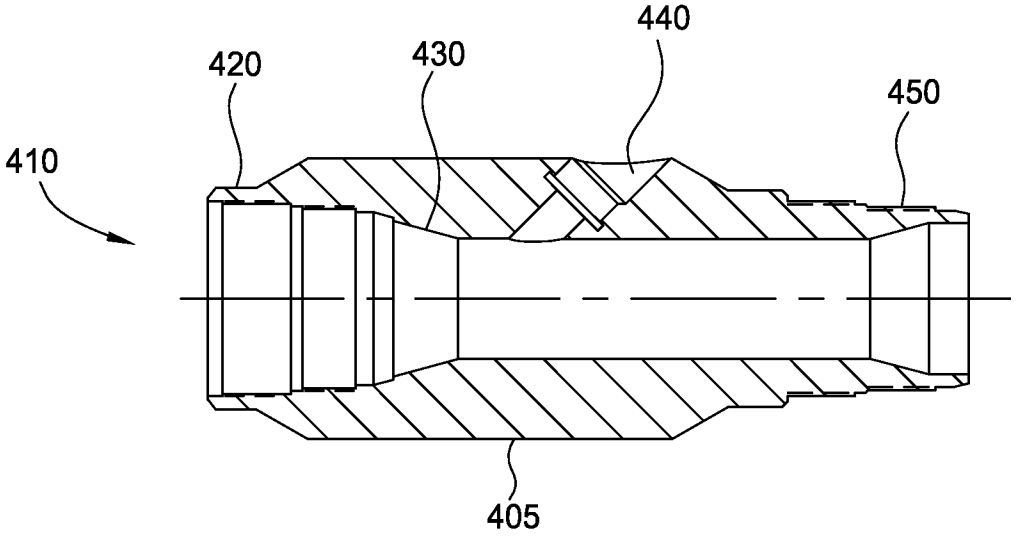
FIG. 4 illustrates a cross sectional view of an injection port according to one embodiment of the invention.

FIG. 4 illustrates the injection port 400 according to one embodiment of the invention. The injection port 400 allows fluid communication between the assembly 100 and the annulus surrounding the assembly 100 within the wellbore. The injection port 400 includes a cylindrical body 405 having a bore 410 disposed through the body 405. The inner diameter of an upper end 420 of the body 405 may be connected to the packer 300, the spacer pipe 130, and/or other downhole tool that may be included in the assembly 100. The outer diameter of a lower end 450 of the body 405 may be connected to the packer 300, the spacer pipe 130, and/or other downhole tool that may be included in the assembly 100. The bore 410 of the body 405 may include a restriction section 430 for increasing the flow rate of fluid introduced through the bore 410 of the injection port 400 prior to communication with a port 440 for injection into the annulus surrounding the injection port 400 during a fracturing operation. The bore 410 and the port 440 may be protected with an erosion resistant material such as tungsten carbide. Alternatively, the entire injection port 400 may be formed from an erosion resistant material such as tungsten carbide. In one embodiment, the injection port 400 may include removable tungsten carbide inserts located within the port 440. In one embodiment, the injection port 400 may include a plurality of ports 440.

Figure 5A:
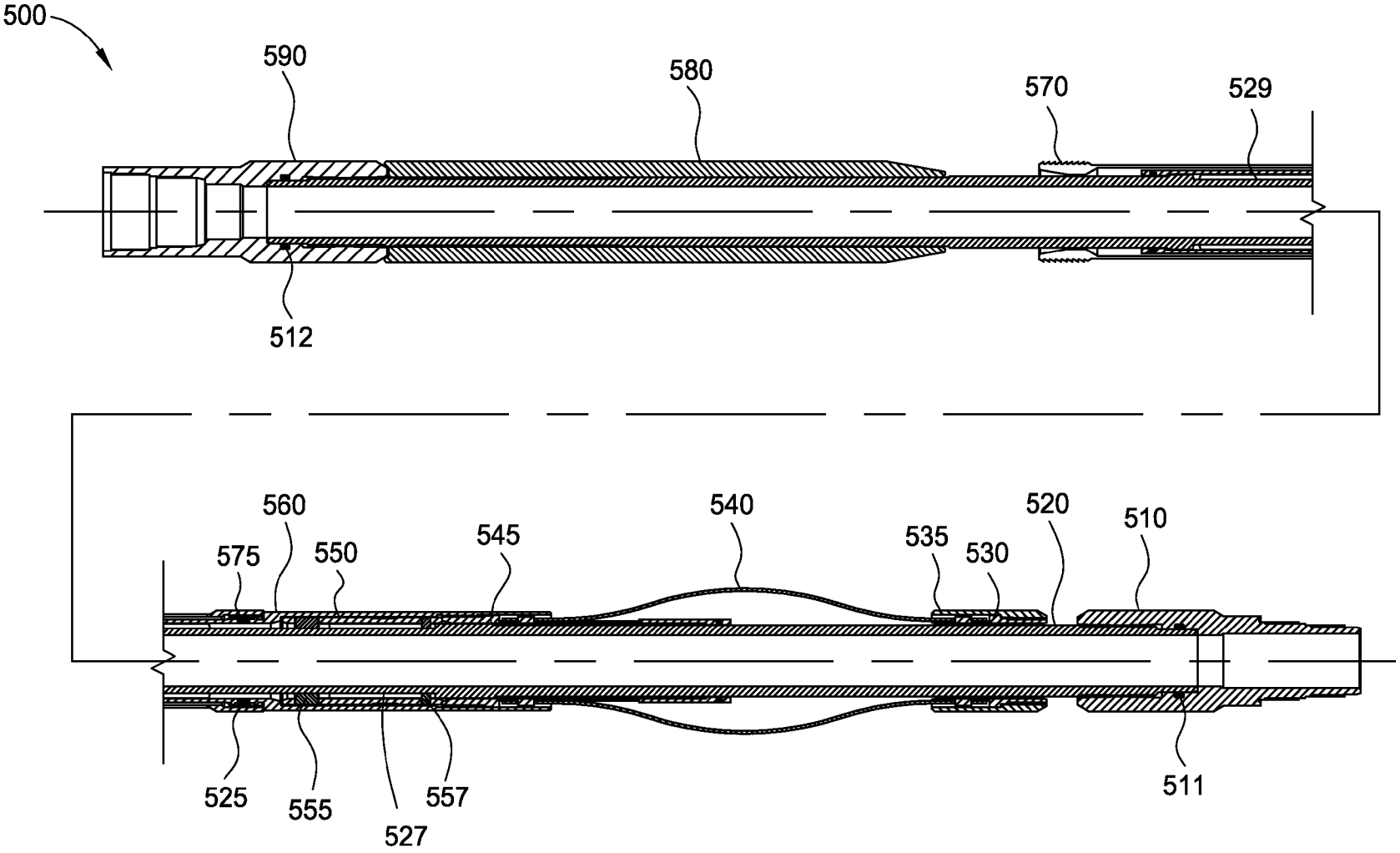
FIG. 5A illustrates a cross sectional view of an anchor in an unset position according to one embodiment of the invention.

FIG. 5A illustrates the anchor 500 in an un-actuated position according to one embodiment of the invention. The anchor 500 includes a top sub 510, an inner mandrel 520, first retainer 530, a friction section 540 (such as a drag spring or block), a second retainer 545, an inner sleeve 550, an outer sleeve 560, a slip 570, a cone 580, and a bottom sub 590. The top sub 510 includes a cylindrical body having a bore disposed through the body. The upper end of the top sub 510 may be coupled to the packer 300 or other downhole tool that may be included in the assembly 100. The lower end of the top sub 510 may be coupled to the inner mandrel 520. A seal 511, such as an o-ring, may be provided between the top sub 510/inner mandrel 520 interface.

The inner mandrel 520 includes a cylindrical body having a bore disposed through the body and slots 525 longitudinally disposed along the outer diameter of the inner mandrel 520. In one embodiment, the inner mandrel 520 may include a pair of slots 525. The slots 525 may be symmetrically located on the outer diameter of the inner mandrel 520. As will be described below, the slots 525 facilitate setting and unsetting of the anchor 500.

The friction section 540 includes a plurality of members 541 radially disposed around the inner mandrel 520 that are secured to the inner mandrel 520 at their ends with the first retainer 530 and the second retainer 545 such that the center portions of the members project outwardly from the inner mandrel 520. The friction section 540 allows axial movement of the inner mandrel 520 relative to the members 541, the outer sleeve 560, and the slip 570 by generating friction between the members 541 and the surrounding wellbore as the friction section 540 engages and moves along the surrounding wellbore. The first retainer 530 includes a cylindrical body having a bore disposed through the body, through which the inner mandrel 520 is provided. The upper end of the members 541 may include openings that engage raised portions on the outer diameter of the first retainer 530. A cover 535 may be coupled around the first retainer 530 to prevent disengagement of the raised portions on the outer diameter of the first retainer 530 and the openings in the upper end of the members 541. The cover 535 includes a cylindrical body having a bore disposed through the body, through which the first retainer 530 and the inner mandrel 520 are provided. The cover 535 may be coupled to the first retainer 530. The first retainer 530 and the cover 535 may be axially movable relative to the inner mandrel 520.

At the opposite side, the lower end of the members 541 may similarly be coupled to the second retainer 545. The second retainer 545 includes a cylindrical body having a bore disposed through the body, through which the inner mandrel 520 is provided. The second retainer 545 includes raised portions on its outer diameter for engaging openings disposed through the lower end of the members 541. The outer sleeve 560 may be coupled around the second retainer 545 to prevent disengagement of the raised portions on the outer diameter of the second retainer 545 and the openings in the lower end of the members 541. The outer sleeve 560 includes a cylindrical body having a bore disposed through the body, through which the first retainer 530, the inner sleeve 550, and the inner mandrel 520 are provided. The upper end of the outer sleeve 560 may be coupled to the second retainer 545. The second retainer 545 and the outer sleeve 560 may be axially movable relative to the inner mandrel 520.

The lower end of the outer sleeve 560 may include a shoulder disposed on its inner diameter that engages a shoulder disposed on the outer diameter of the inner mandrel 520 to limit the axial movement between the two components. Coupled to the lower end of the outer diameter of the outer sleeve 560 is the slip 570. The slip 570 may be coupled to the outer sleeve 560 via a threaded insert 575 that is partially disposed in the body of the outer sleeve 560. The slip 570 may include a plurality of slip members, such as collets, radially disposed around the slip 570 having teeth disposed on the outer periphery of the ends of the slip members to engage and secure the anchor 500 in the wellbore. The ends of the slip members include a tapered inner diameter for receiving the corresponding tapered outer surface of the cone 580. Upon engagement between the outer surface of the cone 580 and the inner surface of the slip 570, the cone 580 projects the slip members outwardly into engagement with the surrounding wellbore to set and secure the anchor 500 in the wellbore. In one embodiment, the wellbore may be lined with casing. In one embodiment, the wellbore may be an open hole and may not include any lining or casing.

The cone 580 includes a cylindrical body having a bore disposed through the body, through which the inner mandrel 520 is provided. The cone 580 has a tapered nose operable to engage the tapered inner surface of the slip 570. The cone 580 is axially fixed relative to the inner mandrel 520 and abuts the upper end of the bottom sub 590. The bottom sub 590 includes a cylindrical body having a bore disposed through the body, through which the inner mandrel 520 is partially provided. The upper end of the bottom sub 590 is coupled to the lower end of the inner mandrel 520. A seal 512, such as an o-ring, may be provided between the bottom sub 590/inner mandrel 520 interface. The lower end of the bottom sub 590 may be configured to connect to a variety of other downhole tools that may be included or attached to the assembly 100.

To set and unset the slip 570 by engagement with the cone 580, the relative movement between the inner mandrel 520 (and thus the cone 580) and the outer sleeve 560 (and thus the slip 570) is controlled with a pair of lugs 555 and a pair of pins 557 that are disposed through the inner sleeve 550 and facilitated with the friction section 540. The friction section 540 creates a friction interface with the wellbore to allow the inner mandrel 520 to move axially relative to the outer sleeve 560 as the assembly 100 is raised and lowered. The inner sleeve 550 includes a cylindrical body having a bore disposed through that body that is disposed between the upper end of the outer sleeve 560 and the inner mandrel 520, adjacent the second retainer 545. The inner sleeve 550 is rotatable relative to the outer sleeve 560 and the inner mandrel 520, as the inner mandrel 520 is moved in an "up and down" motion relative to the inner sleeve 550 and the outer sleeve 560. The lugs 555 and the pins 557 are further seated within the slots 525 located on the outer diameter of the inner mandrel 520.

Figure 5B:
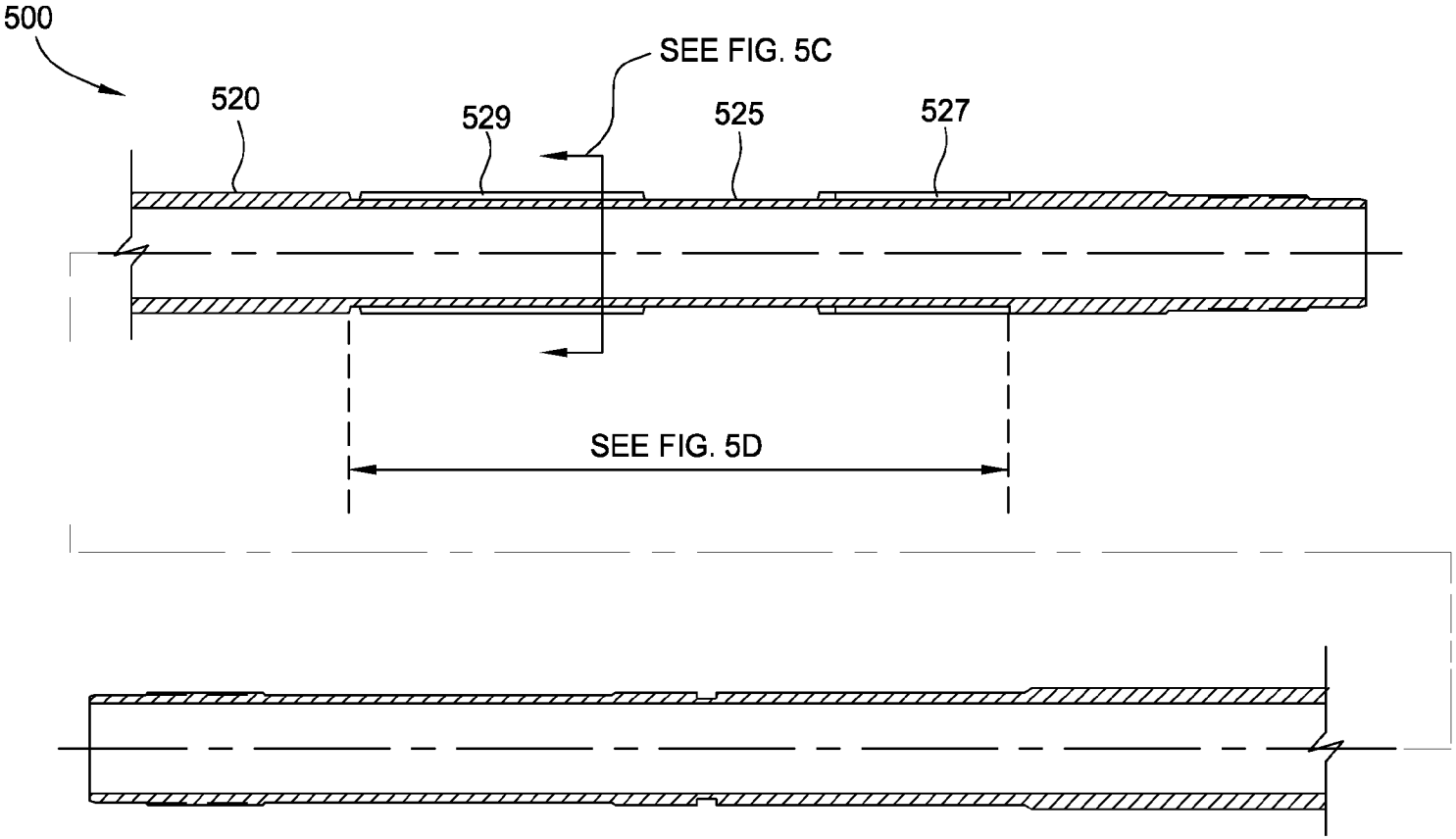
FIG. 5B illustrates a cross sectional view of an inner mandrel of the anchor according to one embodiment of the invention.
Figure 5C:
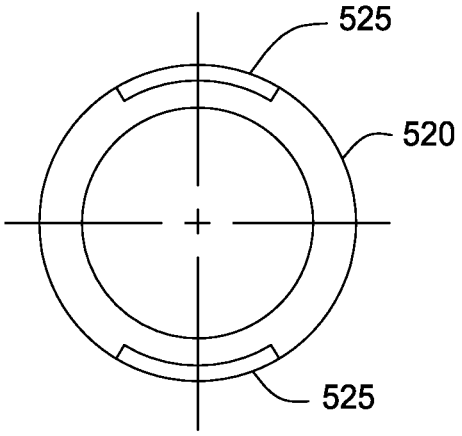
FIG. 5C illustrates a top cross sectional view of the inner mandrel of the anchor according to one embodiment of the invention.
Figure 5D:
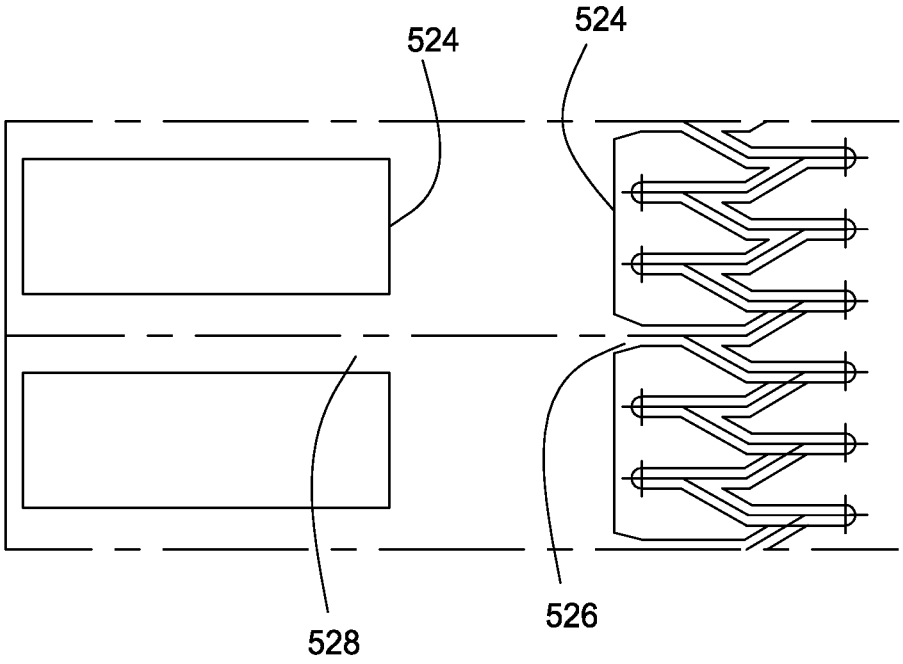
FIG. 5D illustrates a track and channel layout of the inner mandrel according to one embodiment of the invention.
Figure 5E:
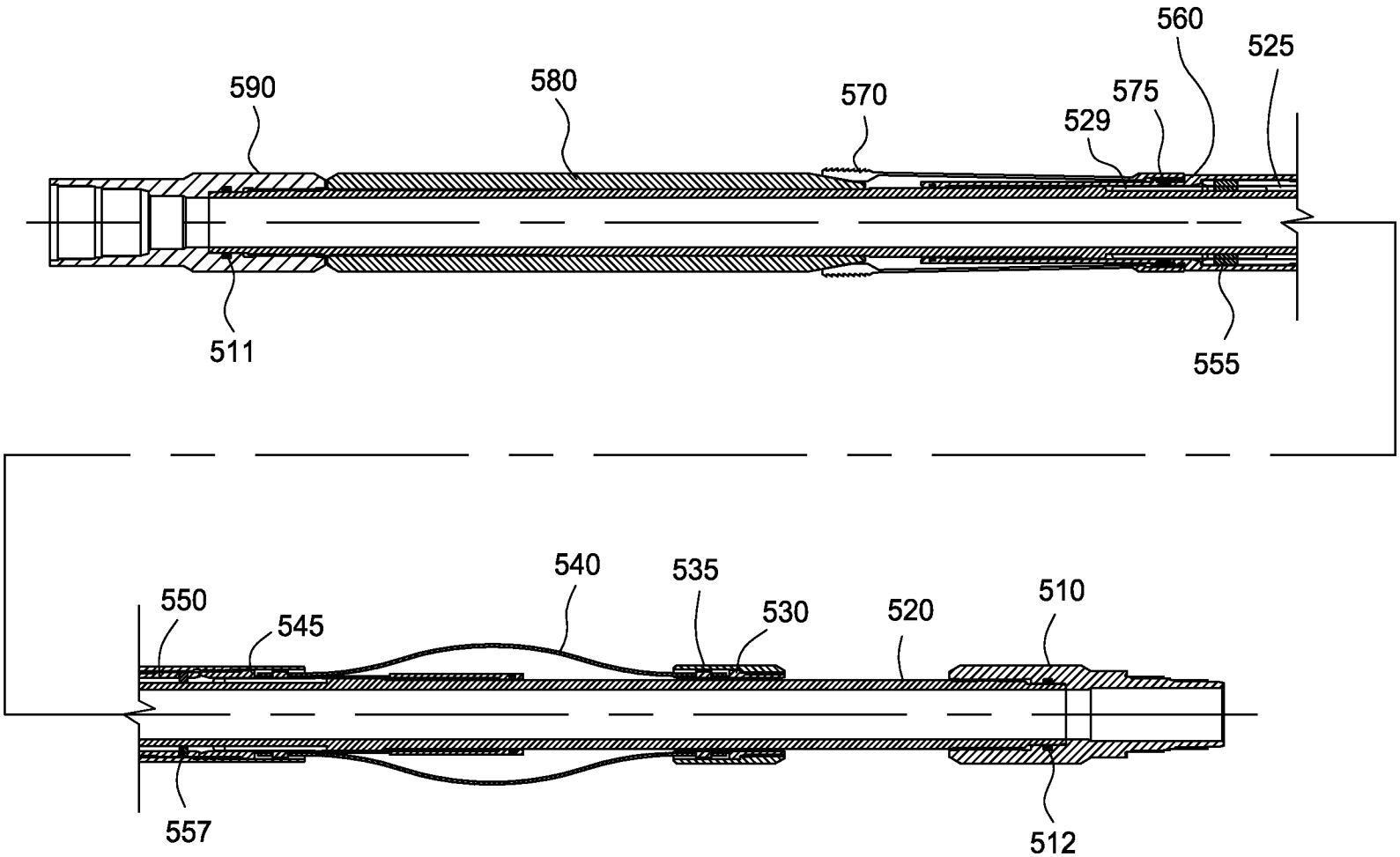
FIG. 5E illustrates a cross sectional view of the anchor in a set position according to one embodiment of the invention.

As illustrated in FIGS. 5B-5D, the slots 525 include a cam portion 527, along which the pins 557 travel, and a channel portion 529, through which the lugs 555 may travel to set and release the anchor 500. When the pins 557 are located within the cam portion 527, the anchor 500 is prevented from setting. The cam portion 527 includes a plurality of lanes having linear sections and helical sections that are directed into adjacent lanes. The cam portion 527 further includes exits 526 in lanes that communicate and align with channels 528 of the channel portion 529. As the inner mandrel 520 is pulled and pushed in an "up and down" motion, via the top sub 510 that is coupled to the tubing string 110 through the remainder of the assembly 100, the pins 557 move along the lanes of the cam portion 527 and are continuously directed into adjacent lanes such that the outer sleeve 550 rotates relative to the inner mandrel 520. The pins 557 travel along the cam portion 527 until they reach exits 526 and are allowed to exit from the cam portion 527 by an upward or pull force. As the inner mandrel 520 is directed in the "up and down" motion, the lugs 555 may be aligned with and located relative to the pins 557 to engage the outer rims 524 of the cam portion 527 and the channel portion 529 to prevent the pins 557 from contacting the ends of the lanes in the cam portion 527 and protect them from bearing any excessive loads induced by forces applied to the inner mandrel 520. When the pins 557 reach an exit 526, the lugs 555 may travel into channels 528, which keeps the pins 557 in alignment with the exits 526 and allows further axial movement of the inner mandrel 520. Upon the pins 557 exiting and the lugs 555 traveling within the channels 528 by the upward or pull force, the inner mandrel 520 is permitted to move further axially relative to the outer sleeve 560, thereby allowing the cone 580 to engage the slip 570 and actuate the slip members into engagement with the wellbore, as illustrated in FIG. 5E. After the slip 570 is engaged with the wellbore, the assembly 100 is secured in the wellbore as it is held in tension via the tubing string 110.

To unset the slip 570, the tension in the assembly 100 is released and/or a downward or push force is applied to the inner mandrel 520, using the tubing string 110, thereby reintroducing the pins 557 onto the cam portion 527 via the exits 526 and permitting the cone 580 to retract from engagement with the slip 570 and the slip members to retract from engagement with the wellbore. Once the pins 557 are directed into the cam portion 527, the pins 557, the lugs 555, and the cam portion 527 limit the axial movement between the cone 580 and the slip 570 to prevent setting of the slip 570 as described above. In alternative embodiments, the cam portion 527 may include other configurations that allow the pins 557 to move along the cam portion 527 and to exit/enter the cam portion 527 to set and unset the anchor 100. After the anchor 500 is released from engagement with the wellbore, the assembly 100 may be relocated to another area of interest or location in the wellbore to conduct another fracturing or other downhole operation following the operation of the assembly 100 described herein.

Figure 6A:
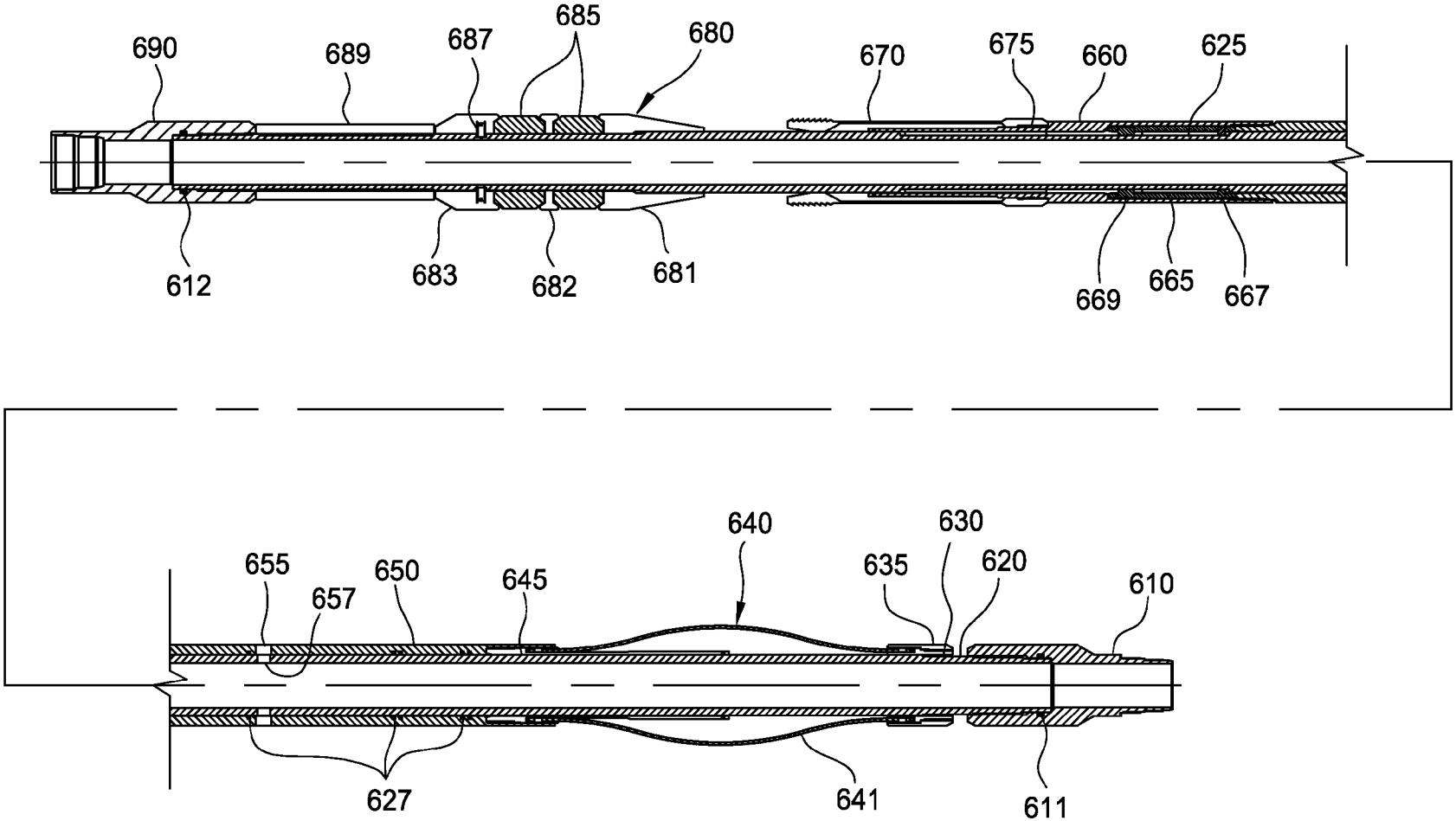
FIG. 6A illustrates a cross sectional view of an anchor in an unset position according to one embodiment of the invention.

FIG. 6A illustrates an embodiment of an anchor assembly 600 in an un-actuated position. The anchor assembly 600 may be used in combination with the embodiments of the assembly 100 described herein. The anchor 600 includes a top sub 610, an inner mandrel 620, a first retainer 630, a friction section 640 (such as a drag spring or block), a second retainer 645, an unloading sleeve 650, an outer sleeve 660, a slip 670, a cone assembly 680, and a bottom sub 690. The top sub 610 includes a cylindrical body having a bore disposed through the body. The upper end of the top sub 610 may be coupled to the packer 300 or other downhole tool that may be included in the assembly 100. The lower end of the top sub 610 may be coupled to the inner mandrel 620. A seal 611, such as an o-ring, may be provided between the top sub 610/inner mandrel 620 interface.

The inner mandrel 620 includes a cylindrical body having a bore disposed through the body, one or more ports 657, and slots 625 longitudinally disposed along the outer diameter of the inner mandrel 620. The ports 657 are operable to facilitate unloading of the pressure in the assembly 100 and to facilitate unsetting of the packer 300 located above the anchor 600 by equalizing the pressure across the packer. In one embodiment, the inner mandrel 620 may include a pair of slots 625. The slots 625 may be symmetrically located on the outer diameter of the inner mandrel 620. As described above with respect to FIGS. 5B-D, the slots 625 similarly facilitate setting and unsetting of the assembly 600.

The friction section 640 includes a plurality of members 641 radially disposed around the inner mandrel 620 that are secured to the inner mandrel 620 at their ends with the first retainer 630 and the second retainer 645 such that the center portions of the members project outwardly from the inner mandrel 620. The friction section 640 allows axial movement of the inner mandrel 620 relative to the members 641, the sleeves 650 and 660, and the slip 670 by generating friction between the members 641 and the surrounding wellbore as the friction section 640 engages and moves along the surrounding wellbore. The first retainer 630 includes a cylindrical body having a bore disposed through the body, through which the inner mandrel 620 is provided. The upper end of the members 641 may include openings that engage raised portions on the outer diameter of the first retainer 630. A cover 635 may be coupled around the first retainer 630 to prevent disengagement of the raised portions on the outer diameter of the first retainer 630 and the openings in the upper end of the members 641. The cover 635 includes a cylindrical body having a bore disposed through the body, through which the first retainer 630 and the inner mandrel 620 are provided. The cover 635 may be coupled to the first retainer 630. The first retainer 630 and the cover 635 may be axially movable relative to the inner mandrel 620.

At the opposite side, the lower end of the members 641 may similarly be coupled to the second retainer 645. The second retainer 645 includes a cylindrical body having a bore disposed through the body, through which the inner mandrel 520 is provided. The second retainer 645 includes raised portions on its outer diameter for engaging openings disposed through the lower end of the members 641. The unloading sleeve 650 may be coupled to the second retainer 645 to prevent disengagement of the raised portions on the outer diameter of the second retainer 645 and the openings in the lower end of the members 641. The unloading sleeve 650 includes a cylindrical body having a bore disposed through the body, through which the first retainer 630 and the inner mandrel 620 are provided. The unloading sleeve 650 also includes one or more ports 655 that communicate with the one or more ports 657 in the inner mandrel 620 when the ports are aligned, generally when the anchor 600 is in the unset position. The ports 655 and 657 provide fluid communication between the assembly 100 and the wellbore surrounding the assembly to relieve pressure internal of the assembly 100 and to help equalize the pressure across the packer 300 located above the anchor 600. One or more seals 627, such as o-rings, may be located between the loading sleeve 650/inner mandrel 620 interface to provide seals above and below the ports 655 and 657. The upper end of the unloading sleeve 650 may be coupled to the second retainer 645. The inner mandrel 620 is axially moveable relative to the second retainer 645 and the unloading sleeve 650.

Coupled to the lower end of the unloading sleeve 650, is the outer sleeve 660. The outer sleeve 660 may include a cylindrical body having a bore therethrough, which surrounds the inner mandrel 620 and an inner sleeve 665. The lower end of the outer sleeve 660 is coupled to the slip 670. The slip 570 may be coupled to the outer sleeve 660 via a threaded insert 675 that is partially disposed in the body of the outer sleeve 660. The slip 670 may include a plurality of slip members, such as collets, radially disposed around the slip 670 having teeth disposed on the outer periphery of the ends of the slip members to engage and secure the anchor 600 in the wellbore. The ends of the slip members include a tapered inner diameter for receiving the corresponding tapered outer surface of the cone assembly 680. Upon engagement between the outer surface of the cone assembly 680 and the inner surface of the slip 670, the cone assembly 680 projects the slip members outwardly into engagement with the surrounding wellbore to set and secure the anchor 600 in the wellbore. In one embodiment, the wellbore may be lined with casing. In one embodiment, the wellbore may be an open hole, and may not include any lining or casing.

The cone assembly 680 includes an upper portion 681, a middle portion 682, a lower portion 683, and one or more packing elements 685 located adjacent the middle portion 682. Each of the portions may include cylindrical bodies having a bore disposed through the body, through which the inner mandrel 620 is provided. The upper portion 681 has a tapered nose operable to engage the tapered inner surface of the slip 670, and an inner shoulder operable to engage a shoulder on the outer diameter of the inner mandrel 620. The packing elements 685 are located one each side of the middle portion 682. Each of the portions includes a lip profile at their outer edges that are operable to retain the packing elements 685 therebetween. The lower portion 683 may be axially and shearably fixed relative to the inner mandrel 620 via a retainer 687. The upper and middle portions 681 and 682 are movable relative to the lower portion 683, to allow actuation of the packing elements 685. Upon engagement with the slip 670, the upper and middle portions 681 and 682 are directed toward the fixed lower portion 683, thereby compressing the packing elements 685 into engagement with the surrounding wellbore. The packing elements 685 may be formed from an elastomeric material.

The lower portion 683 abuts the upper end of a mandrel 689, which abuts the bottom sub 690. The mandrel 689 may include a cylindrical body having a bore therethrough that surrounds the inner mandrel 620. The mandrel 689 may be operable to help position the cone assembly 680 along the lower end of the anchor 600 and to transfer loads from and provide a reactive force against the cone assembly 680. The bottom sub 690 includes a cylindrical body having a bore disposed through the body, through which the inner mandrel 620 is partially provided. The upper end of the bottom sub 690 is coupled to the lower end of the inner mandrel 620. A seal 612, such as an o-ring, may be provided between the bottom sub 690/inner mandrel 620 interface. The lower end of the bottom sub 690 may be configured to connect to a variety of other downhole tools that may be included or attached to the assembly 100.

To set and unset the slip 670, the relative movement between the inner mandrel 620 (and thus the cone 680) and the outer sleeve 660 (and thus the slip 670) is controlled with a pair of lugs 669 and a pair of pins 667 that are disposed through the inner sleeve 665 and facilitated with the friction section 640. The friction section 640 creates a friction interface with the wellbore to allow the inner mandrel 620 to move axially relative to the outer sleeve 660 as the assembly 100 is raised and lowered on the tubing string 110. The inner sleeve 665 includes a cylindrical body having a bore disposed through the body that is disposed between the outer sleeve 660 and the loading sleeve 650. The inner sleeve 665 is rotatable relative to the outer sleeve 660 and the inner mandrel 620, as the inner mandrel 620 is moved in an "up and down" motion relative to the inner sleeve 665 and the outer sleeve 660 by the use of lugs 669 and pins 667 that are seated within the slots 625 located on the outer diameter of the inner mandrel 620. The lugs 669 and pins 667 are actuated along the slots 625 as described above with the operation of the anchor 500, as shown in FIGS. 5B-5D. Upon actuation of the lugs 669/pins 667/slots 625/outer sleeve 665 interface, the cone assembly 680 is directed into engagement with the slip 670, via the inner mandrel 620 and the top sub 610, by an upward or pull force on the tubing string 110 of the assembly 100.

Figure 6B:
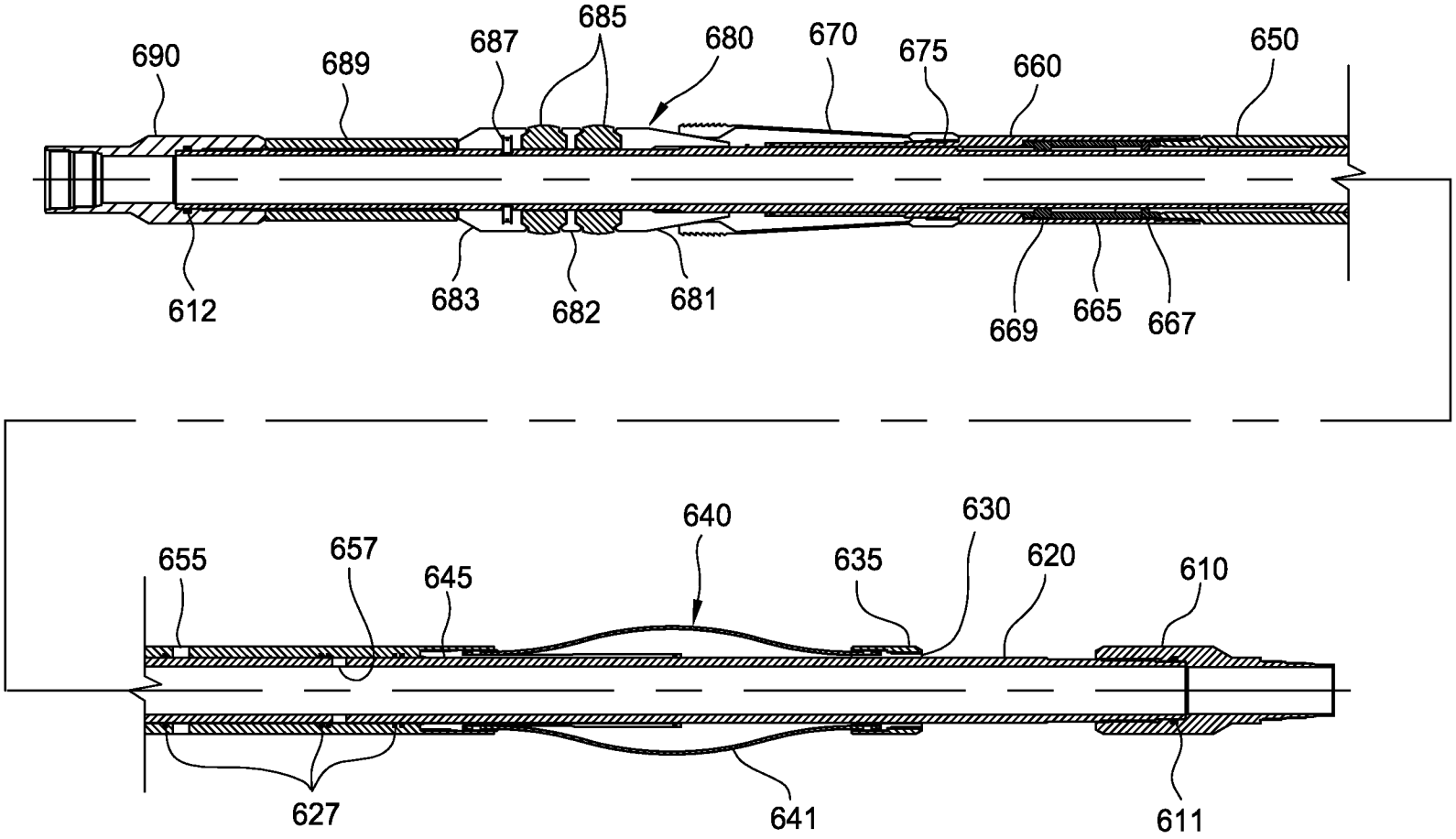
FIG. 6B illustrates a cross sectional view of the anchor in a set position according to one embodiment of the invention.
Figure 6C:
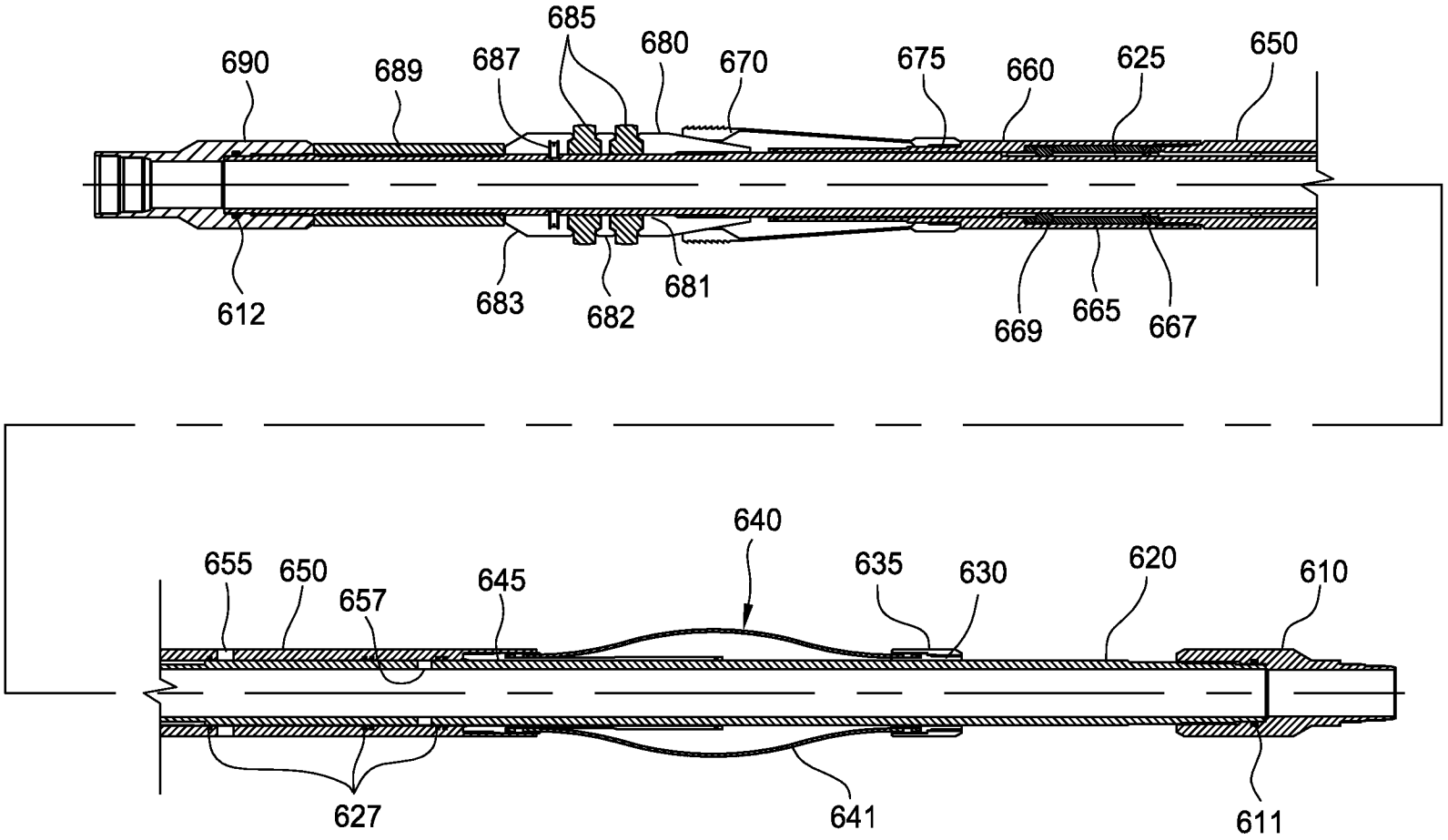
FIG. 6C illustrates a cross sectional view of the anchor in a pack-off position according to one embodiment of the invention.

FIG. 6B illustrates the initial engagement of the slip 670 and the cone assembly 680. The slip 670 is projected into engagement with the surrounding wellbore and the packing elements 685 are compressed within the cone assembly 600. Further tensioning of the assembly 600 forces the cone assembly 680 to project the slips into a set position within the wellbore and allows the packing elements to sealingly engage the wellbore, as shown in FIG. 6C. Also shown in FIGS. 6B and 6C are the ports 655 and 657 sealinlgy isolated from each other. When the anchor 600 is in the set position, fluid communication is closed between the throughbore of the anchor 600 and the surrounding wellbore. This allows a fracturing operation to be conducted without a loss of pressure through the anchor 600 using the embodiments described above.

To unset the slip 670 and the packing elements 685, the tension in the assembly 100 is released and/or a downward or push force is applied to the inner mandrel 520, using the tubing string 110, thereby permitting the cone assembly 680 to retract from engagement with the slip 670. The slip members and the packing elements retract from engagement with the wellbore, and the packing elements 685 retract the middle and upper portions of the cone assembly 600 from the lower portion. When the anchor 600 is in an unset position, the ports 655 and 657 may open fluid communication between the throughbore of the anchor 600 and the surrounding wellbore to equalize the pressure differential therebetween, as well as across the packer 300 located above the anchor 600. After the anchor 600 is released from engagement with the wellbore, the assembly 100 may be relocated to another area of interest or location in the wellbore to conduct another fracturing or other downhole operation following the operation of the assembly 100 described herein.

In one embodiment, an assembly 100 may include a first anchor 600, an injection port 400 coupled to and disposed below the first anchor 600, a second anchor 600 coupled to and disposed below the injection port 400, and a plug, such as a solid blank pipe having no throughbore or a closed end of the injection port 400 or the second anchor 600, disposed between the throughbores of the injection port 400 and the second anchor 600 so that flow through the assembly 100 is injected out through the injection port 400. The assembly 100 may be coupled to a tubing string to operate the assembly 100 as described above. When the assembly 100 actuated by applying a mechanical force (such as an upward or pull force) to the tubing string, the first and second anchors 600 are actuated to secure the assembly 100 in the wellbore and seal an area of interested located between the packing elements 685 of each of the anchors 600. A treatment fluid may be supplied through the tubing string and the first anchor 600, and injected into the area of interest by the injection port 400. Fluid communication between the anchors 600 and the wellbore is closed when the anchors 600 are in a set position. After a treatment operation is conducted, the mechanical force may be released and/or a downward or pull force may be applied to the tubing string to release the slips 670 and unset the packing elements 685 of the anchors 600 from engagement with the wellbore. The pressure within the assembly 100 and the wellbore may be equalized, and the pressure across the packing elements 685 of each anchor may be equalized to facilitate unsetting of the packing elements 685, by opening fluid communication between the anchors 600 and the wellbore. Fluid communication is opened between the anchors 600 and the wellbore as the anchors 600 are unset and the ports 657 and 655 are aligned. Pressure may be directed through the ports 657 and 655 of the first anchor 600 to equalize the pressure across the packing elements 685 of the first anchor 600. Pressure may be directed through the lower end of the second anchor 600 to the wellbore to equalize the pressure across the packing elements 685 of the second anchor 600. In an alternative embodiment, instead of a plug, the treatment fluid may be prevented from flowing through the assembly 100 using other embodiments described above, such as a ball and seat or an overpressure valve located at the lower end of the second anchor 600 to open and close fluid communication therethrough.

Figures 1, 7A:
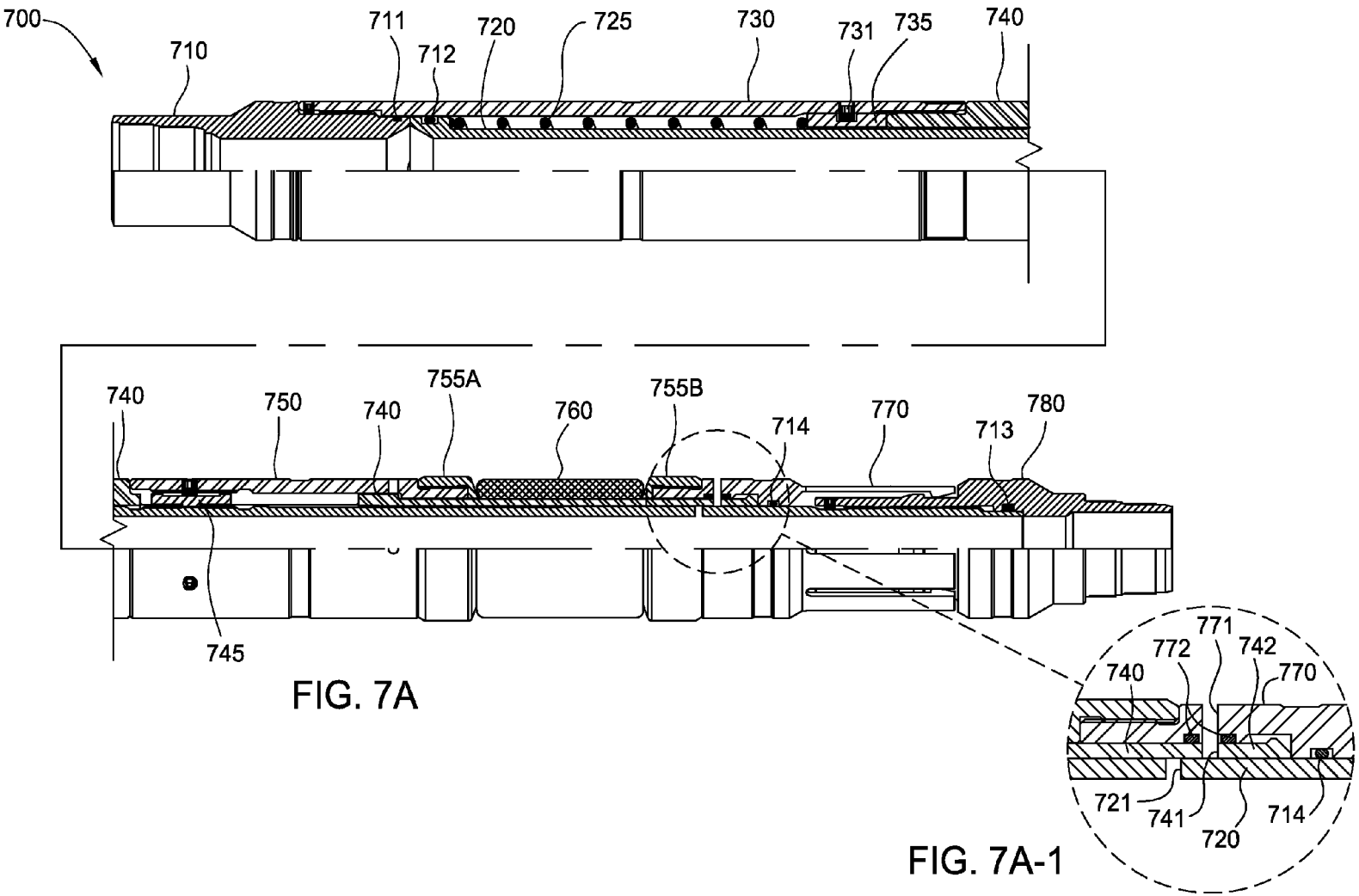

FIG. 7A illustrates a cross sectional view of a packer 700 in an unset position according to one embodiment of the invention. The packer 700 may be used in combination with the embodiments of the assembly 100 described herein. The packer 700 may be used in place of either or both packers 300A and 300B as shown in FIG. 1. In one embodiment, the assembly 100 may include an unloader 200, a packer 300A, an injection port 400, a packer 700, and an anchor 500. The bottom end of the assembly 100 below the anchor 500 may be sealed using a device such as a packer or plug to prevent fluid communication through the bottom end of the assembly 100. The packers 300A and 700 are similar in operation and are positioned in tandem within the assembly 100 so that they may be simultaneously actuated, or alternatively, one packer may be set and/or unset prior to the other packer. The packer 700 may be configured as part of the assembly 100 to be selectively actuated by an upward or pull force that induces tension in the assembly 100, via the tubing string 110 for example. The packer 700 is operable, for example, to straddle or sealingly isolate an area of interest in a formation for conducting a fracturing operation to recover hydrocarbons from the formation. As described herein with respect to unsetting the assembly 100, the application of one or more mechanical forces to achieve the unsetting sequence may be accomplished merely by releasing the tension which had been applied to set the assembly 100 in place initially, or may be supplemented by additional force applied by springs within the components and/or by setting weight down on the assembly 100.

The packer 700 includes a top sub 710, an inner mandrel 720, an upper housing 730, a spring mandrel 740, a lower housing 750, a packing element 760, a latch sub 770, and a bottom sub 780. The top sub 710 includes a cylindrical body having a bore disposed through the body. The inner diameter of the upper end of the top sub 710 may be configured to connect to the injection port 400 or other downhole tool included in the assembly 100. The lower end of the top sub 710 is coupled to the upper end of the upper housing 730. The top sub 710/upper housing 730 interface may be secured together using, for example, a set screw. The top sub 710/upper housing 730 interface may also include a seal 711, such as an o-ring.

The upper housing 730 includes a cylindrical body having a bore disposed through the body, through which the inner mandrel 720 is provided. The upper housing 730 surrounds the upper end of the inner mandrel 720 such that the bottom end of the top sub 710 abuts the top end of the inner mandrel 720. A seal 712, such as an o-ring, may be provided between the upper housing 730/inner mandrel 720 interface. The upper housing 730 encloses a biasing member 725 that surrounds the inner mandrel 720. The biasing member 725 may include a spring that abuts a shoulder formed on the outer diameter of the upper end of the inner mandrel 720 at one end and abuts the upper end of a retainer 735 at the other end, thereby biasing the inner mandrel 720 against the bottom end of the top sub 710. The biasing member 725 may be used to facilitate unsetting of the packing element 760. The retainer 735 includes a cylindrical body having a bore disposed through the body, through which the inner mandrel 720 is provided. The retainer 735 is surrounded by and coupled to the upper housing 730 by a set screw 731. In an alternative embodiment, the retainer 735 may be integral with the upper housing 730 in the form of a shoulder, for example, on the upper housing 730 against which the biasing member 725 abuts.

The lower end of the upper housing 730 is coupled to the upper end of the spring mandrel 740. The spring mandrel 740 includes a cylindrical body having a bore disposed through the body, in which the inner mandrel 720 is provided. The inner diameter of the lower end of the upper housing 730 may be coupled to the outer diameter of the upper end of the spring mandrel 740 such that the upper end of the spring mandrel abuts the retainer 735. Between its upper and lower ends, the spring mandrel 740 includes longitudinal slots disposed on its outer diameter for receiving a member 745 that also facilitates actuation of the packing element 760. The member 745 is disposed on and coupled to the inner mandrel 720, and is surrounded by and further coupled to the lower housing 750. The member 745 may include a recess on its outer diameter for receiving a set screw disposed through the body of the lower housing 750 to axially fix the lower housing 750 relative to the inner mandrel 720. The lower housing 750 includes a cylindrical body having a bore disposed through the body, through which the inner mandrel 720 is provided. Also, the lower end of the lower housing 750 surrounds a portion of the spring mandrel 740 such that a shoulder formed on the inner diameter of the lower housing 750 abuts a shoulder formed on the outer diameter of the spring mandrel 740.

FIG. 7A-1 illustrates the lower end 742 of the spring mandrel 740 coupled to the latch sub 770 to facilitate actuation of the packing element 760. The spring mandrel 740 may be coupled to the latch sub 770 by placing the latch sub 770 around the lower end 742 of the spring mandrel 740 and then placing the spring mandrel 740/latch sub 770 over the inner mandrel 720. The lower end 742 of the spring mandrel 740 may include a shoulder or one or more latching fingers, such as collets, used to engage an inner shoulder of the latch sub 770. The lower end 742 of the spring mandrel 740 also includes one or more openings 741, such as a port or slot, disposed through the body of the spring mandrel 740 to facilitate unsetting of the packing element 760 (further described below). The latch sub 770 also includes one or more openings 771, such as a port or slot, disposed through the body of the latch sub 770 to facilitate unsetting of the packing element 760 (further described below). One or more seals 772, such as o-rings, may be used to seal the spring mandrel 740/latch sub 770 interface. The inner mandrel 720 may also include one or more openings 721, such as a port or slot, disposed through the body of the inner mandrel 720 to facilitate unsetting of the packing element 760 (further described below). As illustrated in the unset position, the openings 741 and 771 of the spring mandrel 740 and the latch sub 770, respectively, may be completely or at least partially aligned.

As stated above, the lower end of the spring mandrel 740 may be connected to the latch sub 770, which includes one or more latching fingers, such as collets, that engage the outer diameter of the bottom sub 780. The packing element 760 may include an elastomer that is disposed around the spring mandrel 740 and between an upper and lower gage 755A and 755B. The gages 755A and 755B are connected to the outer diameters of the lower housing 750 and the latch sub 770, respectively, and include radially inward projecting ends that engage the ends of the packing element 760 to actuate the packing element 760. The latch sub 770/inner mandrel 720 interface may also include a seal 714, such as an o-ring.

The bottom sub 780 includes a cylindrical body having a bore disposed through the body and is coupled to the lower end of the inner mandrel 720. The bottom sub 780/inner mandrel 720 interface may be secured together using, for example, a set screw. The bottom sub 780/inner mandrel 720 interface may also include a seal 713, such as an o-ring. A recessed portion on the outer diameter of the bottom sub 780 is adapted for receiving the latching fingers of the latch sub 770 to prevent premature actuation of the packing element 760. The lower end of the bottom sub 780 may be configured to be coupled to the spacer pipe 130, the anchor 500, or other downhole tool that may be included in the assembly 100.

Figures 1, 7B:
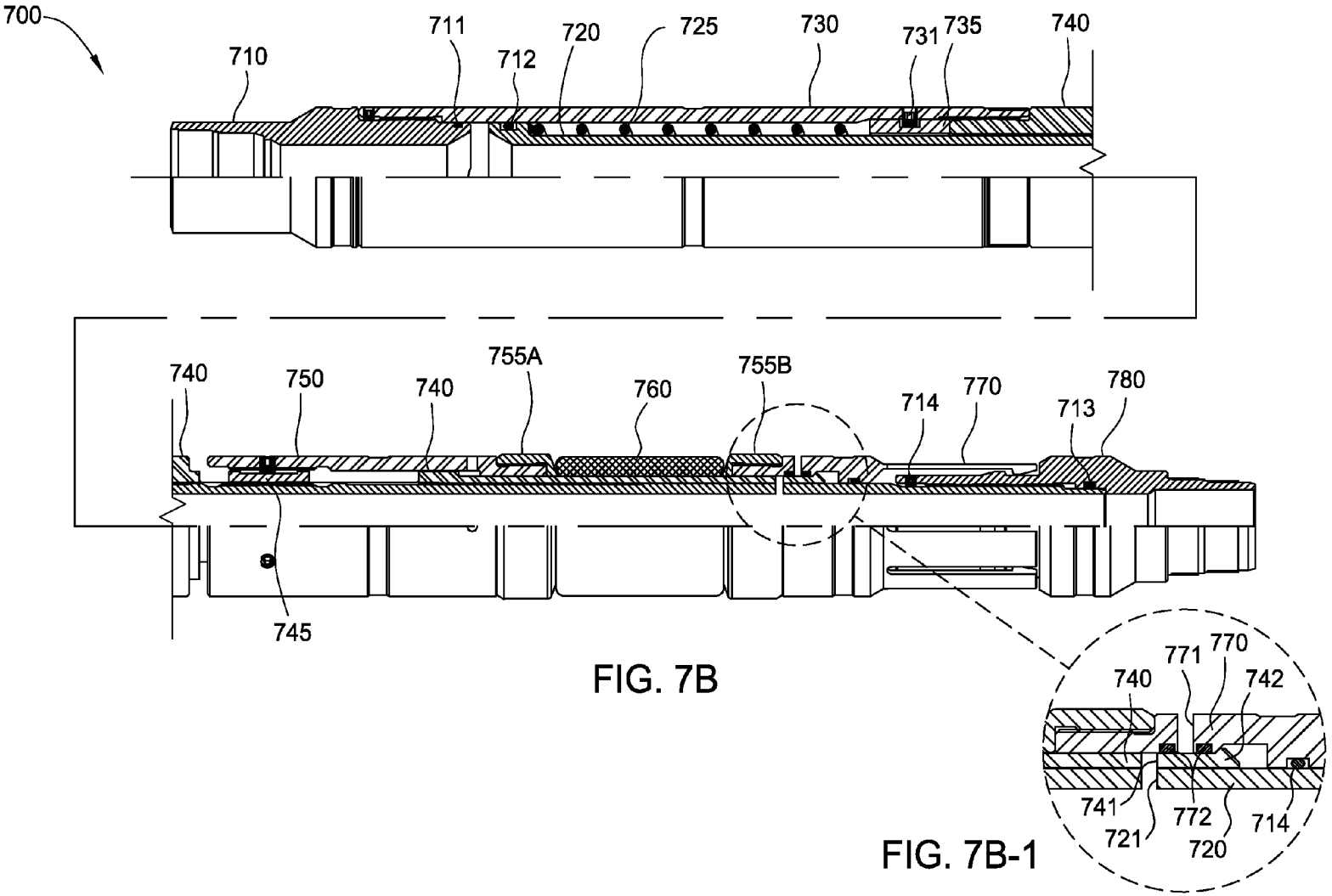

FIG. 7B illustrates the packer 700 in a pre-set position according to one embodiment of the invention. The top sub 710, the upper housing 730, the retainer 735, and the spring mandrel 740 are axially movable relative to the inner mandrel 720, the lower housing 750, the packing element 760, the latch sub 770, and the bottom sub 780. As the assembly 100 is tensioned, the top sub 710 is separated from the inner mandrel 720, thereby compressing the biasing member 725 between the shoulder on the inner mandrel 720 and the retainer 735, and the spring mandrel 740 is separated from the lower housing 750, thereby axially moving along the outer diameter of the inner mandrel 720 and engaging the latch sub 770. As illustrated in FIG. 7B-1 the lower end 742 of the spring mandrel 740 engages the inner shoulder of the latch sub 770 to facilitate setting of the packing element 760 upon further tensioning of the assembly 100. As illustrated in the pre-set position, the opening 741 of the spring mandrel 740 completely or at least partially aligns with the opening 721 on the inner mandrel 720, but the openings 721 and 741 are sealingly isolated from the opening 771 of the latch sub 770 via the seals 772, thereby preventing fluid communication between the interior of the packer 700 and the annulus surrounding the packer 700.

Figures 1, 7C:
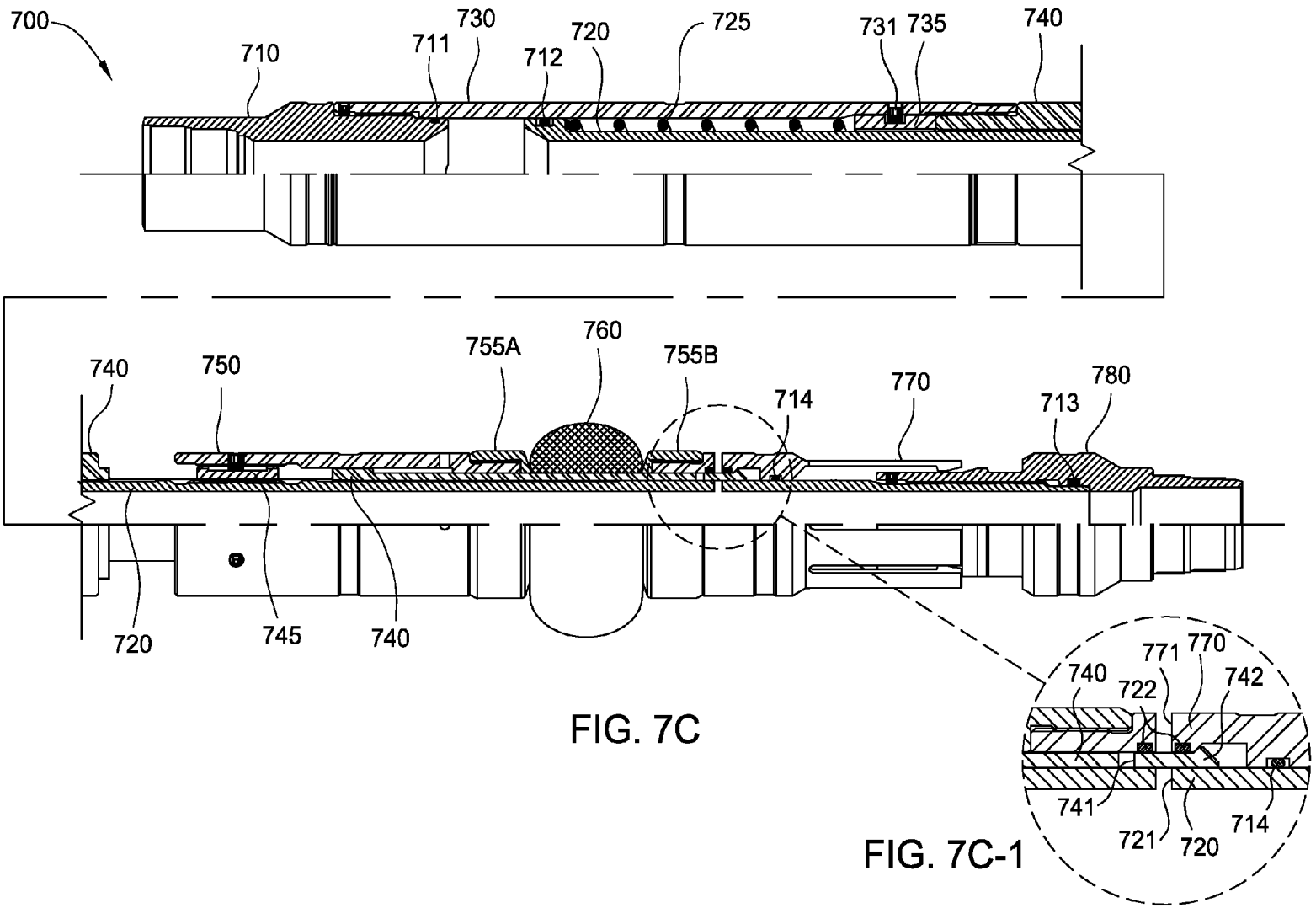

FIG. 7C illustrates the packer 700 in a set position according to one embodiment of the invention. The top sub 710, the upper housing 730, the retainer 735, the spring mandrel 740, and the latch sub 770 are axially movable relative to the inner mandrel 720, the lower housing 750, and the bottom sub 780. As the assembly 100 is further tensioned, the top sub 710 is further separated from the inner mandrel 720, thereby further compressing the biasing member 725 between the shoulder on the inner mandrel 720 and the retainer 735, and the spring mandrel 740 is further separated from the lower housing 750, thereby axially moving along the outer diameter of the inner mandrel 720 and pulling on the latch sub 770. Upon the upward or pull force applied to the top sub 710, via the tubing string 110 for example, the latching fingers of the latch sub 770 disengage from the bottom sub 780 to allow actuation of the packing element 760. The latch sub 770 and thus the lower gage 755B are axially moved toward the stationary lower housing 750 and upper gage 755A to actuate the packing element 760 disposed therebetween. The lower housing 750 is axially fixed by the anchor 500 via the member 745, inner mandrel 720, and bottom sub 780. The packing element 760 is actuated into sealing engagement with the surrounding surface, which may be the wellbore for example. As illustrated in FIG. 7C-1, the opening 741 of the spring mandrel 740 is moved away from alignment with the opening 721 of the inner mandrel 720, and the opening 771 of the latch sub 770 is moved into complete or at least partial alignment with the opening 721 of the inner mandrel. The openings 721 and 741 are still sealingly isolated from the opening 771 of the latch sub 770 via the seals 772, thereby preventing fluid communication between the interior of the packer 700 and the annulus surrounding the packer 700.

Once the packer 700 is set, fluid pressure that is introduced into the assembly 100 for the fracturing operation may boost the sealing effect of the packing element 760 by telescoping apart the top sub 710 and the inner mandrel 720 as the pressure acts on the bottom end of the top sub 710 and the top end of the inner mandrel 720. The bottom sub 780 may include a piston shoulder on its inner diameter to counter balance the boost enacted upon the packing element 760 to control setting and unsetting of the packing element 760. By releasing the tension in the assembly 100 and/or pushing on the tubing string 110, the top sub 710 and thus the latch sub 770 may be retracted, with further assistance from the biasing member 725, relative to the inner mandrel 720 to unset the packing element 760.

Figures 1, 7D:
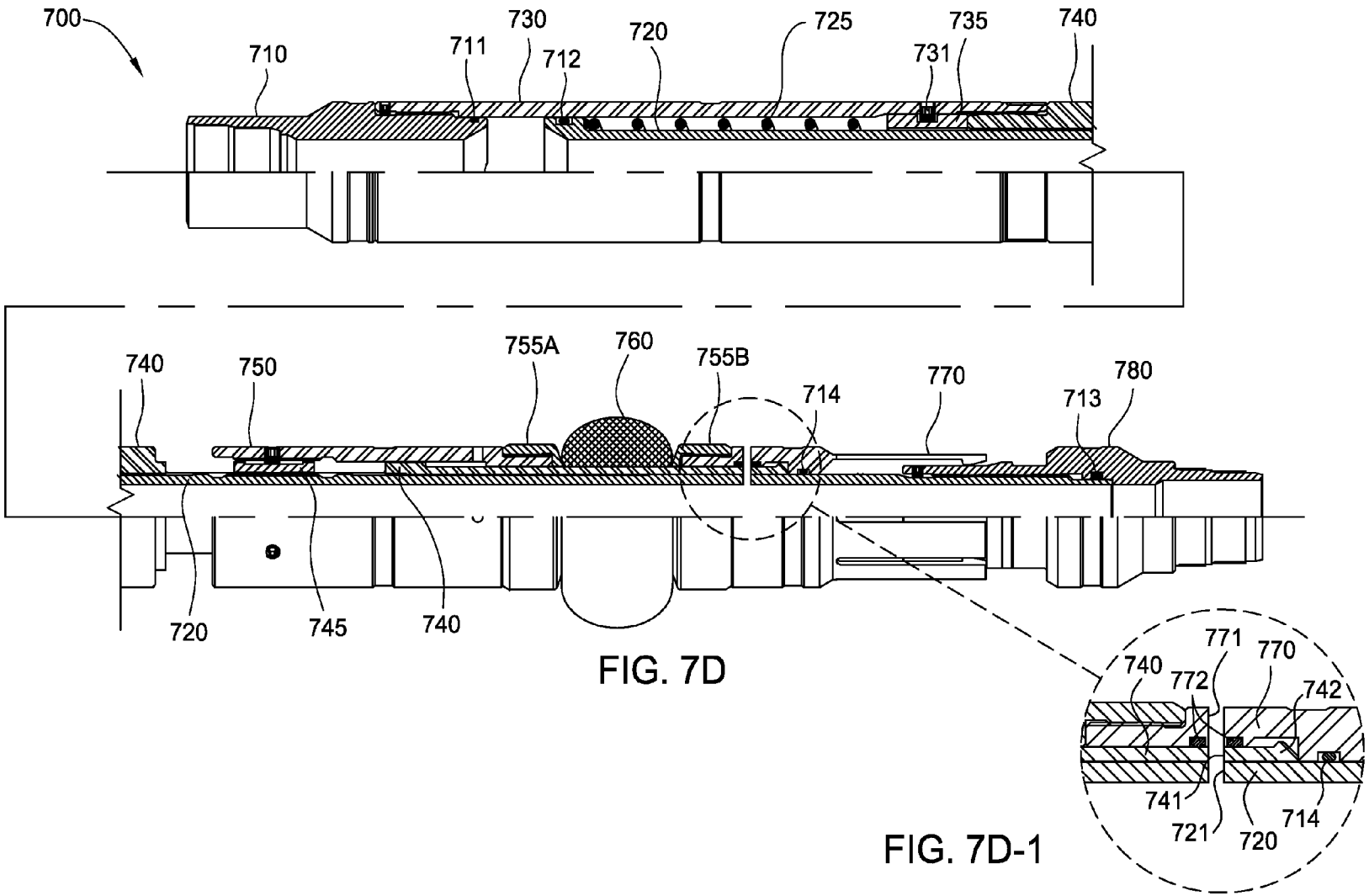

FIG. 7D illustrates a cross sectional view of the packer 700 in an unloading position according to one embodiment of the invention. The packer 700 is operable to facilitate unsetting of the packing element 760 in one aspect by reducing the pressure differential across the packing element 760. If a large pressure differential exists across the packing element 760 or some event occurs that inhibits the packing element 760 from unsetting, the openings 771, 741, and 721, of the latch sub 770, spring mandrel 740, and inner mandrel 720, respectively, completely or at least partially align upon movement of the spring mandrel 740 into the unset position to open fluid communication with the interior of the packer 700. By releasing the tension in the assembly 100 and/or pushing on the tubing string 110, the top sub 710 and thus the spring mandrel 740 may be retracted, with further assistance from the biasing member 725, relative to the inner mandrel 720, the packing element 760, and the latch sub 770. As illustrated in FIG. 7D-1, the lower end 742 of the spring mandrel 740 is moved relative to the inner mandrel 720 and the latch sub 770 to allow each of the openings 771, 741, and 721 to completely or at least partially align to open fluid communication between the interior of the inner mandrel 720 and the annulus surrounding the packer 700 below the packing element 760. The lower end 742 of the spring mandrel 740 may abut the opposing inner shoulder of the latch sub 770 to move the latch sub 770 into the unset position and allow unsetting of the packing element 760. Upon further retraction of the assembly 100, the packer 700 may be directed to the unset position.

A method of conducting a wellbore treatment operation is provided. The method may include lowering an assembly on a tubular string into a wellbore. The assembly may include an unloader, a first packer, an injection port, a second packer, and an anchor. A seal, such as a plug, may be disposed at a bottom end of the assembly to prevent fluid communication therethrough. The method may include locating the injection port adjacent an area of interest in the wellbore and applying a mechanical force to the assembly, thereby placing the assembly in tension to secure the assembly in the wellbore. The method may include applying a mechanical force to the anchor, thereby setting the anchor to secure the assembly in the wellbore. The mechanical force may be applied to the second packer, thereby actuating the second packer into a preset position and closing fluid communication between an interior of the assembly and the annulus surrounding the second packer. The method may include further applying the mechanical force to the second packer, thereby actuating the second packer into a set position such that the second packer sealingly engages the surrounding wellbore and isolates a lower end of the area of interest. The mechanical force may be applied to the first packer, thereby actuating the first packer into a set position such that the first packer sealingly engages the surrounding wellbore and isolates an upper end of the area of interest. The mechanical force may be applied to the unloader, thereby actuating the unloader into a set position such that the unloader closes fluid communication between the interior of the assembly and the annulus surrounding the unloader above the first packer.

Once the assembly is secured in the wellbore and actuated into a set position, the wellbore treatment operation may proceed by flowing a fluid through the tubular string and the assembly and injecting the fluid into the area of interest via the injection port located between the first and second packers. After completion of the wellbore treatment operation, a mechanical force may be applied to the unloader to actuate the unloader into an unset position, thereby opening fluid communication between the interior of the assembly and the annulus surrounding the unloader above the first packer. Therefore, in such a configuration, an open fluid communication path exists between the annulus below the first packer and the annulus above the first packer via the unloader and the injection port. This open fluid communication may allow pressure equalization across the first packer. The mechanical force may also be applied to the first packer to actuate the first packer into an unset position, thereby releasing the sealed engagement with the wellbore. A further mechanical force may be applied to the second packer to actuate the second packer into an unloading position, thereby opening fluid communication between the interior of the assembly and the annulus surrounding the second packer. In the unloading position, one or more openings in the second packer may be at least partially aligned to open communication between the interior of the second packer and the annulus surrounding the second packer. Therefore, in such a configuration, an open fluid communication path exists between the annulus below the second packer and the annulus above the second packer via the one or more openings of the second packer and the injection port. This open fluid communication may allow pressure equalization across the second packer The mechanical force may further be applied to the second packer to actuate the second packer into an unset position, thereby releasing the sealed engagement with the wellbore. The mechanical force may be applied to the anchor to actuate the anchor into an unset position, thereby releasing the secured engagement with the wellbore and releasing the assembly from engagement with the wellbore. As described herein with respect to unsetting the assembly, the application of one or more mechanical forces to achieve the unsetting sequence may be accomplished merely by releasing the tension which had been applied to set the assembly in place initially, or may be supplemented by additional force applied by springs within the components and/or by setting weight down on the assembly. The assembly may then be removed from the wellbore or located to another area of interest to conduct another wellbore treatment operation as described above.

Figure 8A:
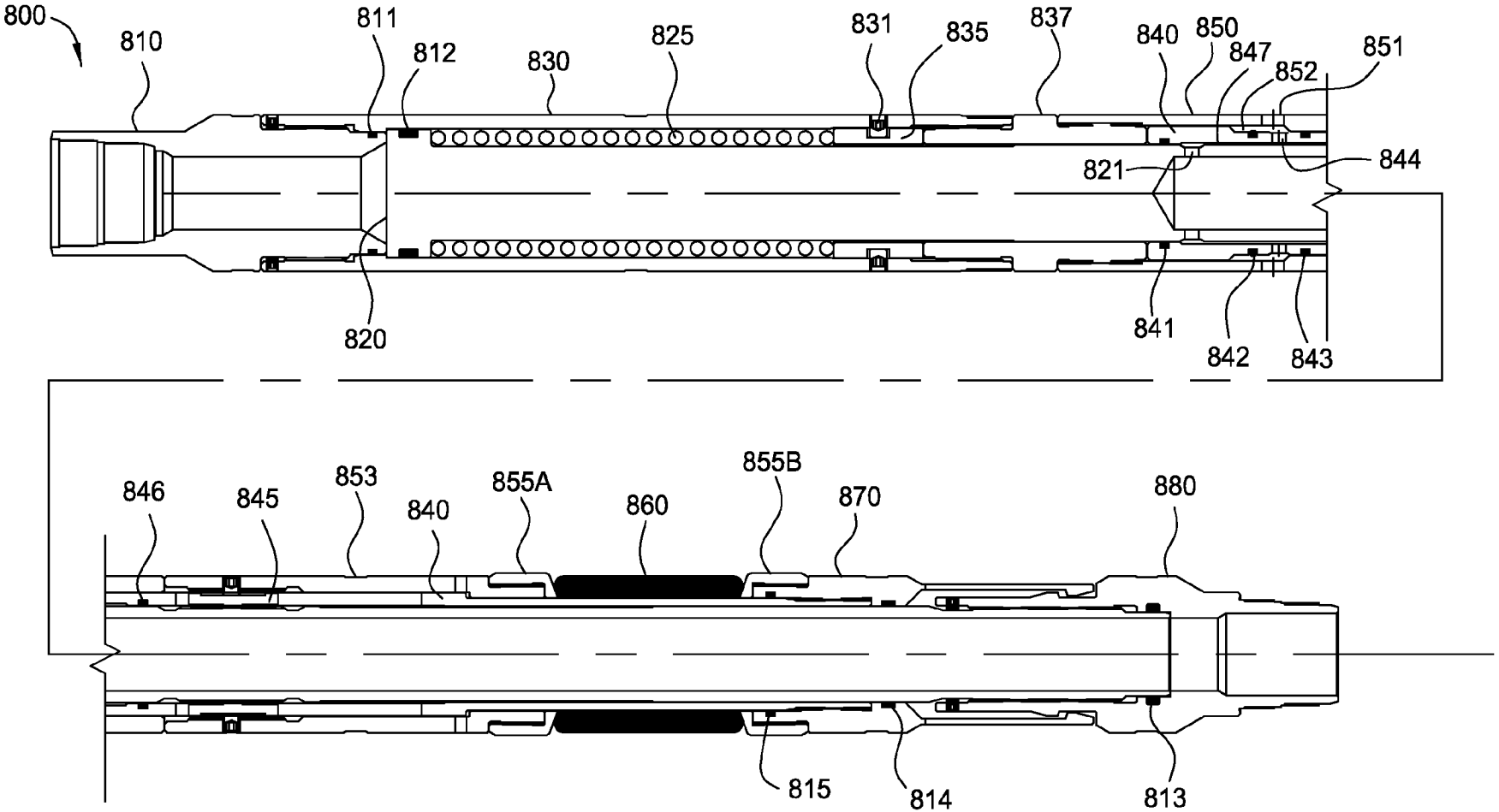
FIG. 8A illustrates a cross sectional view of a packer in an unset position according to one embodiment of the invention.

FIG. 8A illustrates a cross sectional view of a packer 800 in an unset position according to one embodiment of the invention. The packer 800 may be used in combination with the embodiments of the assembly 100 described herein. The packer 800 may be used in place of either or both packers 300A and 300B as shown in FIG. 1. In one embodiment, the assembly 100 may include an unloader 200, a packer 300A, an injection port 400, a packer 800, and an anchor 500. The bottom end of the assembly 100 below the anchor 500 may permit fluid communication through the bottom end of the assembly 100 and into the wellbore. The packers 300A and 800 are similar in operation and are positioned in tandem within the assembly 100 so that they may be simultaneously actuated, or alternatively, one packer may be set and/or unset prior to the other packer. The packer 800 may be configured as part of the assembly 100 to be selectively actuated by an upward or pull force that induces tension in the assembly 100, via the tubing string 110 for example. The packer 800 is operable, for example, to sealingly isolate an area of interest in a formation for conducting a fracturing operation to recover hydrocarbons from the formation.

The packer 800 includes a top sub 810, an inner mandrel 820, an upper housing 830, a coupling member 837, a spring mandrel 840, a sleeve 850, a lower housing 853, a packing element 860, a latch sub 870, and a bottom sub 880. The top sub 810 includes a cylindrical body having a bore disposed through the body. The inner diameter of the upper end of the top sub 810 may be configured to connect to the injection port 400, a tubular, or other downhole tool in the assembly 100. The lower end of the top sub 810 is coupled to the upper end of the upper housing 830. The top sub 810 and the upper housing 830 interface may be secured together using, for example, a set screw. The top sub 810 and the upper housing 830 interface may also include a seal 811, such as an o-ring.

The upper housing 830 includes a cylindrical body having a bore disposed through the body, through which the inner mandrel 820 is provided. The upper housing 830 surrounds the upper end of the inner mandrel 820 such that the bottom end of the top sub 810 abuts the top end of the inner mandrel 820. A seal 812, such as an o-ring, may be provided between the upper housing 830 and the inner mandrel 820 interface. The upper housing 830 encloses a biasing member 825 that surrounds the inner mandrel 820. The biasing member 825 may include a spring that abuts a shoulder formed on the outer diameter of the upper end of the inner mandrel 820 at one end and abuts the upper end of a retainer 835 at the other end, thereby biasing the inner mandrel 820 against the bottom end of the top sub 810. The biasing member 825 may be used to facilitate unsetting of the packing element 860. The retainer 835 includes a cylindrical body having a bore disposed through the body, through which the inner mandrel 820 is provided. The retainer 835 is surrounded by and coupled to the upper housing 830 by a set screw 831. In an alternative embodiment, the retainer 835 may be integral with the upper housing 830 in the form of a shoulder, for example, on the upper housing 830 against which the biasing member 825 abuts.

A coupling member 837 connects the lower end of the upper housing 830 to the upper end of the sleeve 850, such as through a threaded engagement. The coupling member 837 includes a cylindrical body having a bore disposed through the body, in which the inner mandrel 820 is provided. The sleeve 850 also includes a cylindrical body having a bore disposed through the body, in which the inner mandrel 820 as well as the spring mandrel 840 is provided. The spring mandrel 840 includes a cylindrical body having a bore disposed through the body and is located between the sleeve 850 and the inner mandrel 820. The upper end of the spring mandrel 840 may engage the coupling member 837.

In one embodiment, the inner mandrel 820 may include a cylindrical body having a bore disposed through the entire length of the body. Preferably this alternative embodiment of the packer 800 may be used in place of the combination of the packer 300A and the unloader 200 described above.

In another embodiment, the inner mandrel 820 may include a cylindrical body having a bore disposed through the entire length of the body and further include one or more valves, or a ball seat sized for receipt of a ball, in order to selectively control fluid communication through the inner mandrel 820. For example, one or more ball seats may be coupled to the inner mandrel 820 and a ball may be dropped onto the ball seat to close fluid communication through the inner mandrel 820. The ball may subsequently be removed from the seat, such as by using fluid pressure, to open fluid communication through the inner mandrel 820. Preferably this embodiment of the packer 800 may be used in place of the packer 300B described above. In such an instance, an open port may be located below the packer 800 to allow the pressure from the annulus above the packer 800 to be directed to the annulus below the packer 800 to allow the pressure across the packer 800 to be equalized when necessary. Alternatively, an anchor, as described above, having an open throughbore in communication with the wellbore may be located below the packer 800.

In another embodiment, the inner mandrel 820 may include a cylindrical body having a bore disposed through only the lower end of the body. The upper end of the inner mandrel 820 may include a solid tubular member to prevent fluid communication between the upper end and the lower end of the inner mandrel 820. Preferably this embodiment of the packer 800 may be used in place of the packer 300B described above. In such an instance, an open port may be located below the packer 800 to allow the pressure from the annulus above the packer 800 to be directed to the annulus below the packer 800 to allow the pressure across the packer 800 to be equalized when necessary. Alternatively, an anchor, as described above, having an open throughbore in communication with the wellbore may be located below the packer 800.

The inner mandrel 820 further includes an opening 821, such as a port, disposed through its sidewall for fluid communication with an opening 844, such as a port, disposed through the sidewall of the spring mandrel 840 via a chamber 847. The chamber 847 is formed between the outer surface of the inner mandrel 820 and the inner surface of the spring mandrel 840 and is sealed at its ends between one or more seals 841 and 846, which may include o-rings. The sleeve 850 also includes an opening 851, such as a port, disposed through its sidewall for fluid communication with the opening 844 of the spring mandrel 840 via a chamber 852. The chamber 852 is formed between the outer surface of the spring mandrel 840 and the inner surface of the sleeve 850. One or more seals 842 and 843, such as o-rings, surround the opening 844 of the spring mandrel 840 to seal fluid communication between the bore of the inner mandrel 820 and the annulus surrounding the sleeve 850 during operation of the packer 800 described below. The openings 821, 844, and 851 may allow fluid communication between the bore of the inner mandrel 820 and the annulus surrounding the packer 800 when the packer 800 is in the unset position.

Between its upper and lower ends, the spring mandrel 840 includes longitudinal slots disposed on its outer diameter for receiving a member 845 that also facilitates actuation of the packing element 860. The member 845 is disposed on and coupled to the inner mandrel 820, and is surrounded by and further coupled to the lower housing 853. The member 845 may include a recess on its outer diameter for receiving a set screw disposed through the body of the lower housing 853 to axially fix the lower housing 853 relative to the inner mandrel 820. The lower housing 853 includes a cylindrical body having a bore disposed through the body and surrounds a portion of the spring mandrel 840 such that a shoulder formed on the inner diameter of the lower housing 853 abuts a shoulder formed on the outer diameter of the spring mandrel 840.

The lower end of the spring mandrel 840 may be connected to the latch sub 870, which includes one or more latching fingers, such as collets, that engage the outer diameter of the bottom sub 880. The packing element 880 may include an elastomer that is disposed around the spring mandrel 840 and between an upper and lower gage 855A and 855B. The gages 855A and 855B are connected to the outer diameters of the lower housing 853 and the latch sub 870, respectively, and include radially inward projecting ends that engage the ends of the packing element 860 to actuate the packing element 860. The latch sub 870 and the inner mandrel 820 interface may also include a seal 814, such as an o-ring. The latch sub 870 and the spring mandrel 840 interface may also include a seal 815, such as an o-ring.

The bottom sub 880 includes a cylindrical body having a bore disposed through the body and is coupled to the lower end of the inner mandrel 820. The bottom sub 880 and the inner mandrel 820 interface may be secured together using, for example, a set screw. The bottom sub 880 and the inner mandrel 820 interface may also include a seal 813, such as an o-ring. A recessed portion on the outer diameter of the bottom sub 880 is adapted for receiving the latching fingers of the latch sub 870 to prevent premature actuation of the packing element 860. The lower end of the bottom sub 880 may be configured to be coupled to the spacer pipe 130, the anchor 500, or other downhole tool that may be included in the assembly 100.

Figure 8B:
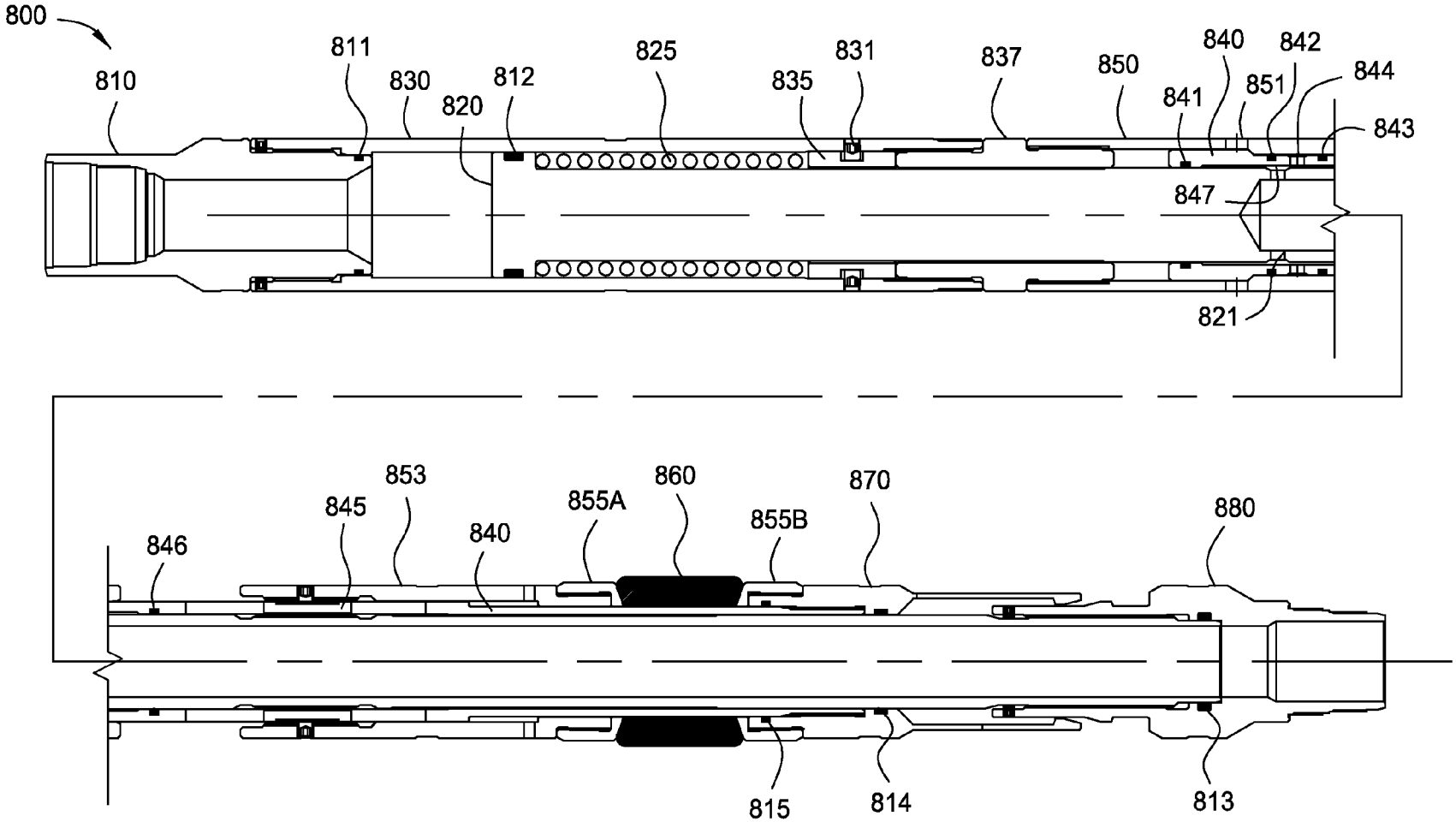
FIG. 8B illustrates a cross sectional view of the packer in a set position according to one embodiment of the invention.

FIG. 8B illustrates the packer 800 in a set position according to one embodiment of the invention. The top sub 810, the upper housing 830, the retainer 835, the coupling member 837, the sleeve 850, the spring mandrel 840, and the latch sub 870 are axially movable relative to the inner mandrel 820, the lower housing 853, and the bottom sub 880. As the assembly 100, and thus the packer 800, is tensioned, the top sub 810 is separated from the inner mandrel 820, thereby compressing the biasing member 825 between the shoulder on the inner mandrel 820 and the retainer 835. A shoulder on the inner surface of the sleeve 850 is moved into contact with a shoulder on the outer surface of the spring mandrel 840, thereby closing fluid communication between the bore of the inner mandrel 820 and the annulus surrounding the packer 800 by isolating the opening 851 using the one or more seals 841, 842, 843, and 846. As the assembly 100, and thus the packer 800, is further tensioned, the sleeve 850 directs the spring mandrel 840 axially along the outer diameter of the inner mandrel 820, which pulls on the latch sub 870. Upon the upward or pull force applied to the top sub 810, via the tubing string 110 for example, the latching fingers of the latch sub 870 disengage from the bottom sub 880 to allow actuation of the packing element 860. The latch sub 870 and thus the lower gage 855B is axially moved toward the stationary lower housing 853 and the upper gage 855A to actuate the packing element 860 disposed therebetween. The lower housing 853 is axially fixed by the anchor 500 via the member 845, inner mandrel 820, and bottom sub 880. The packing element 860 is actuated into sealing engagement with the surrounding surface, which may be the wellbore for example.

In one embodiment, once the packer 800 is set, fluid pressure that is introduced into the assembly 100 for the fracturing operation may boost the sealing effect of the packing element 860 by telescoping apart the top sub 810 and the inner mandrel 820 as the pressure acts on the bottom end of the top sub 810 and the top end of the inner mandrel 820. The bottom sub 880 may include a piston shoulder on its inner diameter to counter balance the boost enacted upon the packing element 860 to control setting and unsetting of the packing element 860. By releasing the tension in the assembly 100 and/or pushing on the tubing string 110, the top sub 810 and thus the latch sub 870 may be retracted, with further assistance from the biasing member 825, relative to the inner mandrel 820 to unset the packing element 860.

Figure 8C:
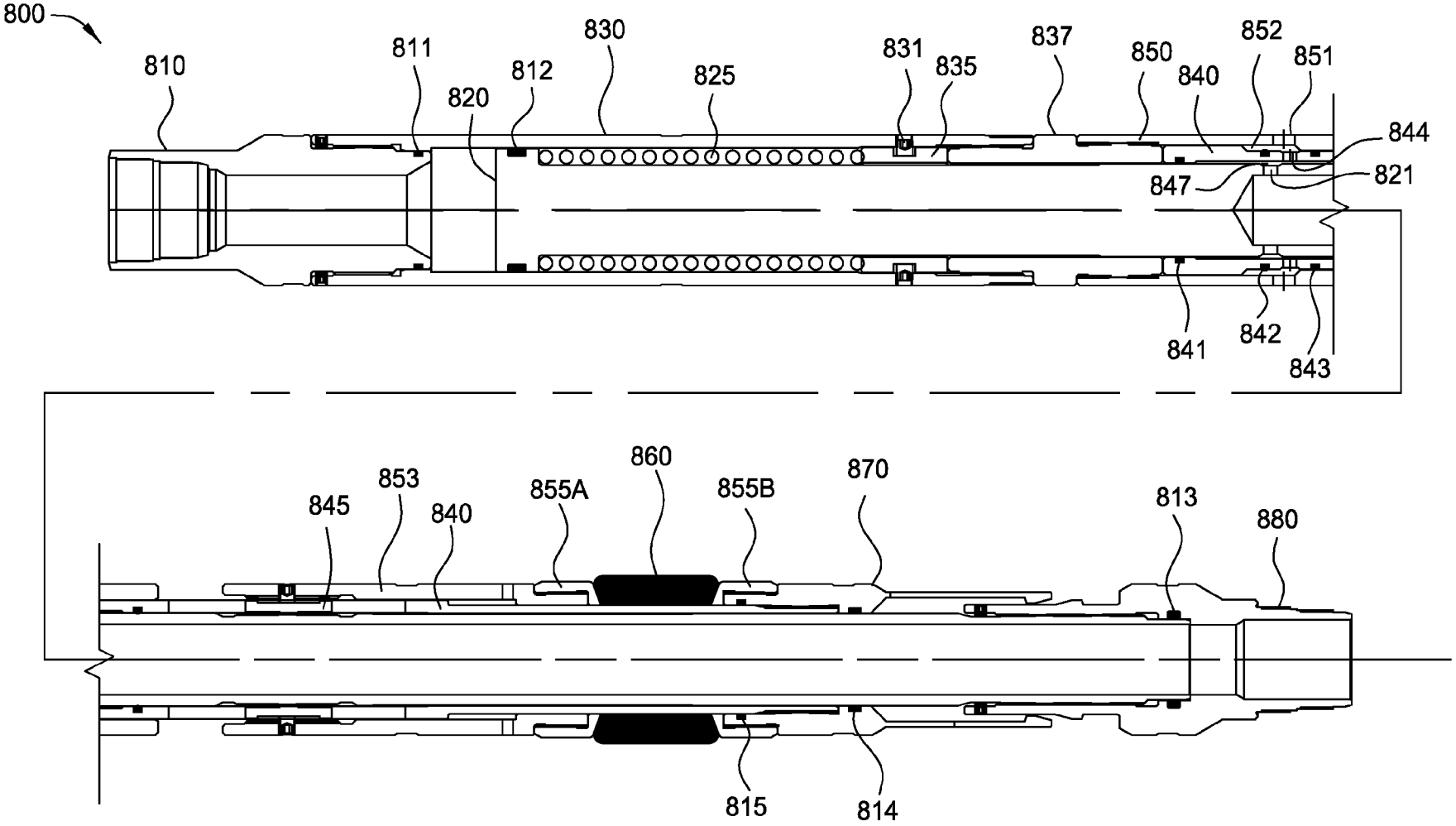
FIG. 8C illustrates a cross sectional view of the packer in an unloading position according to one embodiment of the invention.

FIG. 8C illustrates a cross sectional view of the packer 800 in an unloading position according to one embodiment of the invention. The packer 800 is operable to facilitate unsetting of the packing element 860 in one aspect by reducing the pressure differential across the packing element 860. If a large pressure differential exists across the packing element 860 or some event occurs that inhibits the packing element 860 from unsetting, the openings 821, 844, and 851, of the inner mandrel 820, the spring mandrel 840, and the sleeve 850, respectively, are positioned in fluid communication upon movement of the sleeve 850 relative to the spring mandrel 840 to open fluid communication with the interior of the packer 800. By releasing the tension in the assembly 100 and/or pushing on the tubing string 110, the top sub 810 and thus the sleeve 850 may be retracted, with further assistance from the biasing member 825, relative to the inner mandrel 820, the spring mandrel 840, the packing element 860, and the latch sub 870. The sleeve 850 may move relative to the spring mandrel 840 to allow communication between the openings 821, 844, and 851 via chambers 847 and 852 to open fluid communication between the interior of the inner mandrel 820 and the annulus surrounding the packer 800 above and below the packing element 860. In one embodiment, fluid pressure may be communicated from the annulus surrounding the packer 800 above the packing element 860, to the interior of the packer 800 and through the lower end of the packer 800 and thus the assembly 100, and to the annulus surrounding the packer 800 below the packing element 860. Upon further retraction of the assembly 100, the packer 800 may be directed to the unset position.

A method of conducting a wellbore treatment operation is provided. The method may include lowering an assembly on a tubular string into a wellbore. The assembly may include an unloader, a first packer, an injection port, a second packer disposed below the first packer, and an anchor. In one embodiment, the second packer may include a solid tubular member preventing fluid communication through the second packer. In an alternative embodiment, the second packer may include a bore disposed through the length of the second packer and is selectively operable to open and close fluid communication through bore. The method may include locating the injection port adjacent an area of interest in the wellbore and applying a mechanical force to the assembly, thereby placing the assembly in tension to secure the assembly in the wellbore. The method may include applying a mechanical force to the anchor, thereby setting the anchor to secure the assembly in the wellbore. The method may include applying the mechanical force to the second packer, thereby closing fluid communication between an interior of the second packer and the annulus surrounding the second packer and actuating the second packer into a set position such that the second packer sealingly engages the surrounding wellbore and isolates a lower end of the area of interest. The mechanical force may be applied to the first packer, thereby actuating the first packer into a set position such that the first packer sealingly engages the surrounding wellbore and isolates an upper end of the area of interest. The mechanical force may be applied to the unloader, thereby actuating the unloader into a set position such that the unloader closes fluid communication between the interior of the assembly and the annulus surrounding the unloader above the first packer.

Once the assembly is secured in the wellbore and actuated into a set position, the wellbore treatment operation may proceed by flowing a fluid through the tubular string and the assembly and injecting the fluid into the area of interest via the injection port located between the first and second packers. After completion of the wellbore treatment operation, a mechanical force may be applied to the unloader to actuate the unloader into an unset position, thereby opening fluid communication between the interior of the assembly and the annulus surrounding the unloader above the first packer. Therefore, in such a configuration, an open fluid communication path exists between the annulus below the first packer and the annulus above the first packer via the unloader and the injection port. ThisThe open fluid communication may allow pressure equalization across the first packer to facilitate unsetting of the first packer. The mechanical force may also be applied to the first packer to actuate the first packer into an unset position, thereby releasing the sealed engagement with the wellbore. A further mechanical force may be applied to the second packer to actuate the second packer into an unloading position, thereby opening fluid communication between the annulus surrounding the second packer above the second packer, the interior of the second packer, and the annulus surrounding the second packer below the second packer. In the unloading position, one or more openings in the second packer may be at least partially aligned to open communication between the interior of the second packer and the annulus above the second packer. Therefore, in such a configuration, an open fluid communication path exists between the annulus above the second packer and the annulus below the second packer via the one or more openings of the second packer and the lower end of the assembly which may be open to the annulus of the wellbore. This open fluid communication may allow pressure equalization across the second packer. The mechanical force may further be applied to the second packer to actuate the second packer into an unset position, thereby releasing the sealed engagement with the wellbore. The mechanical force may be applied to the anchor to actuate the anchor into an unset position, thereby releasing the secured engagement with the wellbore and releasing the assembly from engagement with the wellbore. As described herein with respect to unsetting the assembly, the application of one or more mechanical forces to achieve the unsetting sequence may be accomplished merely by releasing the tension which had been applied to set the assembly in place initially, or may be supplemented by additional force applied by springs within the components and/or by setting weight down on the assembly. The assembly may then be removed from the wellbore or located to another area of interest to conduct another wellbore treatment operation as described above.

While the foregoing is directed to embodiments of the invention, other and further embodiments of the invention may be devised without departing from the basic scope thereof, and the scope thereof is determined by the claims that follow.

We claim:

1. An assembly for conducting a treatment operation in a wellbore, comprising:

a tubing string;

an unloader, wherein the unloader is actuated by a mechanical axial force provided by the tubing string for closing fluid communication between the unloader and the wellbore;

a first packer;

a second packer, wherein the first and second packers are actuated into engagement with the wellbore by the mechanical axial force for sealing an area of interest in the wellbore;

an injection port disposed between the first and second packers for injecting a treatment fluid into the area of interest; and an anchor, wherein the anchor is actuated by the mechanical axial force for securing the assembly in the wellbore, wherein the mechanical axial force is a pull force applied to the unloader, the first packer, the second packer, and the anchor using the tubing string to thereby actuate the unloader, the first packer, the second packer, and the anchor.

2. The assembly of claim 1, wherein the unloader is disposed below the tubing string, wherein the first and second packers are disposed below the unloader, and wherein the anchor is disposed below the first and second packers.

3. The assembly of claim 2, wherein the tubing string is in fluid communication with the unloader, the first packer, and the injection port for supplying the treatment fluid into the area of interest.

4. The assembly of claim 3, further comprising a plug disposed below the injection port, and a second unloader disposed below the plug and above the second packer, wherein the second unloader is actuated by the mechanical axial force to close fluid communication between the second unloader and the wellbore.

5. The assembly of claim 1, wherein the injection port is formed from an erosion resistant material.

6. The assembly of claim 1, wherein the injection port is formed from tungsten carbide.

7. The assembly of claim 1, wherein the anchor comprises:
a body;
a slip coupled to the body;
a cone coupled to the body, wherein the body is movable relative to the slip to direct the cone into engagement with the slip to actuate the slip into engagement with the wellbore; and
a friction section operable to facilitate movement between the body and the slip.

8. The assembly of claim 7, wherein the mechanical axial force moves the body relative to the slip.

9. The assembly of claim 7, wherein the body includes a cam portion disposed on the outer surface of the body operable to limit the relative movement between the body and the slip.

10. The assembly of claim 1, wherein the tubing string is a coiled tubing string.

11. The assembly of claim 1, wherein the mechanical axial force is a tensile force.

12. An assembly for conducting a treatment operation in a wellbore, comprising:
a tubing string;
an unloader, wherein the unloader is actuated by a mechanical axial force provided by the tubing string for closing fluid communication between the unloader and the wellbore;
a first anchor, wherein the first anchor is actuated by the mechanical axial force provided by the tubing string to secure the assembly in the wellbore;
an injection port disposed below the first anchor for injecting a fluid into an area of interest in the wellbore; and
a second anchor disposed below the injection port, wherein the second anchor is actuated by the mechanical axial force to secure the assembly in the wellbore, and wherein the mechanical axial force is a tensile force applied to the unloader, the first anchor and the second anchor to thereby actuate the first anchor and the second anchor into engagement with the wellbore.

13. The assembly of claim 12, wherein the first and second anchors comprise:
a body;
a slip coupled to the body;
a cone coupled to the body, wherein the body is movable relative to the slip to direct the cone into engagement with the slip to actuate the slip into engagement with the wellbore; and
a friction section operable to facilitate movement between the body and the slip.

14. The assembly of claim 12, wherein the first and second anchors are actuated by the mechanical axial force to close fluid communication between the first and second anchors and the wellbore.

15. The assembly of claim 14, wherein the first and second anchors comprise:
a body having a first port disposed through the body;
a sleeve surrounding the body and having a second port disposed through the sleeve, wherein the body is movable relative to the sleeve to open and close fluid communication between the first and second ports.

16. The assembly of claim 12, wherein the first anchor and the second anchor are actuated by the mechanical axial force to seal an area of interest in the wellbore.

17. The assembly of claim 16, wherein the first and second anchors comprise:
a body; and
a packing element coupled to the body, wherein the packing element is operable to sealingly engage the wellbore.

18. The assembly of claim 12, further comprising a plug disposed below the injection port and above the second anchor.

19. The assembly of claim 12, wherein the tubing string is a coiled tubing string.

20. A method of treating an area of interest in a wellbore, comprising:
positioning an assembly adjacent the area of interest using a tubing string;
moving the tubing string in a first direction and then moving the tubing string in an opposite second direction to actuate the assembly, wherein the assembly includes an unloader that is actuated by a mechanical axial force provided by the tubing string for closing fluid communication between the unloader and the wellbore;
applying the mechanical axial force to the assembly using the tubing string to secure the assembly in the wellbore and actuate a packing element of the assembly to seal the area of interest, wherein applying the mechanical axial force to the assembly includes pulling on the tubing string to place the assembly in tension and thereby actuate the packing element into engagement with the wellbore; and
injecting a treatment fluid through the assembly and into the area of interest.

21. The method of claim 20, further comprising releasing the mechanical axial force applied to the assembly, thereby releasing the assembly from a secured engagement to the wellbore.

22. The method of claim 21, further comprising equalizing the pressure between the assembly and the wellbore above and below the area of interest.

23. The method of claim 22, further comprising relocating the assembly adjacent a second area of interest.

24. The method of claim 20, wherein the tubing string is a coiled tubing string.

25. A method of conducting a wellbore operation, comprising:
lowering an assembly on a tubular string into a wellbore, wherein the assembly includes an unloader, a first packer, an injection port, a second packer, and an anchor;
locating the injection port adjacent an area of interest in the wellbore;
applying a mechanical axial force to the assembly using the tubular string, thereby securing the assembly into engagement with the wellbore and actuating the unloader, the first packer, the second packer, and the anchor into a set position, wherein applying the mechanical axial force to the assembly includes pulling on the tubular string to place the assembly in tension and thereby actuate the unloader, the first packer, the second packer, and the anchor into the set position to engage the wellbore;

injecting a fluid through the assembly and into the area of interest using the injection port; and releasing the mechanical axial force being applied to the assembly, thereby releasing the assembly from secured engagement with the wellbore and actuating the unloader, the first packer, the second packer, and the anchor into an unset position.

26. The method of claim 25, further comprising applying the mechanical axial force to the second packer, thereby actuating the second packer into a preset position and closing fluid communication between an interior of the assembly and an annulus of the wellbore surrounding the second packer.

27. The method of claim 25, further comprising applying the mechanical axial force to the second packer, thereby closing fluid communication between an interior of the assembly and an annulus of the wellbore surrounding the second packer.

28. The method of claim 25, further comprising releasing the mechanical axial force being applied to the second packer, thereby actuating the second packer into an unloading position and opening fluid communication between the interior of the assembly and the annulus of the wellbore surrounding the second packer.

29. The method of claim 25, wherein the tubular string is a coiled tubing string.

30. A method of conducting a wellbore operation adjacent an area of interest in a wellbore, comprising:

lowering an assembly coupled to a coiled tubing string into the wellbore, wherein the assembly includes an unloader, a first packer, an injection port, a second packer, and an anchor;

positioning the injection port adjacent the area of interest in the wellbore;

pulling on the coiled tubing string to place the assembly in tension and thereby actuate the unloader, the anchor and the first and second packers into a set position to engage the wellbore;

injecting a fluid through the injection port and into the area of interest; and releasing the tension in the coiled tubing string to unset the anchor, the unloader, and the first and second packers.

* * * * *